US009531113B2

(12) United States Patent
Ohyama et al.

(10) Patent No.: US 9,531,113 B2
(45) Date of Patent: Dec. 27, 2016

(54) FLAT CABLE WATERPROOFING CONNECTOR AND WATERPROOFING CONNECTOR STRUCTURE FOR FLAT CABLE

(71) Applicant: YAZAKI CORPORATION, Tokyo (JP)

(72) Inventors: Kouichi Ohyama, Shizuoka (JP); Keishi Jinno, Shizuoka (JP); Kazunori Miura, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/100,620

(22) Filed: Dec. 9, 2013

(65) Prior Publication Data

US 2014/0094049 A1 Apr. 3, 2014

Related U.S. Application Data

(63) Continuation of application No. PCT/JP2012/067409, filed on Jun. 29, 2012.

(30) Foreign Application Priority Data

Jul. 4, 2011 (JP) ..... 2011-148209
Aug. 11, 2011 (JP) ..... 2011-175614

(51) Int. Cl.
*H01R 13/52* (2006.01)
*H01R 13/58* (2006.01)
(Continued)

(52) U.S. Cl.
CPC ..... *H01R 13/521* (2013.01); *H01R 13/5205* (2013.01); *H01R 13/5845* (2013.01);
(Continued)

(58) Field of Classification Search
CPC ..... H01R 13/58; H01R 13/52; H01R 12/771; H01R 12/772; H01R 12/774; H01R 13/521; H01R 13/5205; H01R 13/5845; H01R 43/24; H01R 43/005; H01R 12/592; H01R 12/77; H01R 2105/00; H01R 2107/00
(Continued)

(56) References Cited

U.S. PATENT DOCUMENTS 5,928,035 A * 7/1999 Jankowsky ..... H01R 12/7052 439/607.36
7,883,359 B2 * 2/2011 Osaki et al. ..... 439/492
(Continued)

FOREIGN PATENT DOCUMENTS

CN 1914771 A 2/2007
CN 101401263 A 4/2009
(Continued)

OTHER PUBLICATIONS

International Search Report and Written Opinion of the International Search Report for PCT/JP2012/067409 dated Sep. 25, 2012.
(Continued)

*Primary Examiner* — Felix O Figueroa
*Assistant Examiner* — Paul Baillargeon
(74) *Attorney, Agent, or Firm* — Kenealy Vaidya LLP

(57) ABSTRACT

A flat cable waterproofing connector includes a flat cable having an insulating covering part where conductor wires are covered with an insulating film, terminals bonded to the conductor wires, and a connector housing engaged with a mating connector so that the terminals are connected to terminals of the mating connector. The flat cable waterproofing connector further includes a resin mold part integrally molded on an end part in a longitudinal direction of the flat cable so as to cover a bonding part between the conductor wires and the terminals, and the resin mold part has a waterproofing mold part for covering the bonding part, and
(Continued)

a holding mold part for covering the flat cable at a deeper side in the longitudinal direction of the flat cable than the waterproofing mold part.

4 Claims, 18 Drawing Sheets

(51) Int. Cl.

| | |
|---|---|
| ***H01R 12/77*** | (2011.01) |
| ***H01R 43/00*** | (2006.01) |
| *H01R 12/59* | (2011.01) |
| *H01R 43/24* | (2006.01) |
| *H01R 105/00* | (2006.01) |
| *H01R 107/00* | (2006.01) |

(52) U.S. Cl.
CPC ..... *H01R 43/005* (2013.01); *H01R 12/592* (2013.01); *H01R 12/77* (2013.01); *H01R 12/772* (2013.01); *H01R 43/24* (2013.01); *H01R 2105/00* (2013.01); *H01R 2107/00* (2013.01)

(58) Field of Classification Search
USPC ..... 439/271, 273, 275, 278, 279, 495, 604, 439/606, 578
See application file for complete search history.

(56) References Cited

U.S. PATENT DOCUMENTS

| | | | | |
|---|---|---|---|---|
| 7,922,535 | B1 * | 4/2011 | Jiang et al. ..... | 439/607.35 |
| 2003/0087551 | A1 | 5/2003 | Okayasu et al. | |
| 2005/0020131 | A1 * | 1/2005 | Beck ..... | H01R 13/521 439/587 |
| 2009/0247003 | A1 | 10/2009 | Igarashi | |
| 2010/0279541 | A1 | 11/2010 | Osaki et al. | |

FOREIGN PATENT DOCUMENTS

| | | | |
|---|---|---|---|
| EP | 0152851 | A2 | 8/1985 |
| EP | 1 317 026 | A1 | 6/2003 |
| JP | 4-58477 | A | 2/1992 |
| JP | 6-68931 | A | 3/1994 |
| JP | 7-106016 | A | 4/1995 |
| JP | 2002-170627 | A | 6/2002 |
| JP | 2002-203632 | A | 7/2002 |
| JP | 2003-142198 | A | 5/2003 |
| JP | 2010-123513 | A | 6/2010 |
| WO | 2005/071792 | A1 | 8/2005 |
| WO | 2009/090998 | A1 | 7/2009 |

OTHER PUBLICATIONS

Japanese Office Action for the related Japanese Patent Application No. 2011-148209 dated Feb. 10, 2015.
Chinese Office Action and Search Report for the related Chinese Patent Application No. 201280033507.6 dated Jun. 2, 2015.
Korean Office Action for the related Korean Patent Application No. 10-2014-7000033 dated May 22, 2015.
Japanese Office Action for the related Japanese Patent Application No. 2011-175614 dated May 12, 2015.

* cited by examiner

FLAT CABLE WATERPROOFING CONNECTOR AND WATERPROOFING CONNECTOR STRUCTURE FOR FLAT CABLE

CROSS REFERENCE TO RELATED APPLICATIONS

This application is a continuation of PCT application No. PCT/JP2012/067409, which was filed on Jun. 29, 2012 based on Japanese patent application (patent application 2011-148209) filed on Jul. 4, 2011 and Japanese patent application (patent application 2011-175614) filed on Aug. 11, 2011, whose contents are incorporated herein by reference. Also, all the references cited herein are incorporated as a whole.

BACKGROUND OF THE INVENTION

The present invention relates to a flat cable waterproofing connector and a water proofing connector structure for a flat cable.

Conventionally, a flat cable in a shape of a flat plate having flexibility has been used as a cable capable of being arranged in a small space. This flat cable is so formed that terminals to be connected to terminals of a mating connector are bonded to those parts where conductor wires of the flat cable are exposed. A bonding part between the conductor wires and the terminals must be subjected to waterproofing treatment. For this reason, there are proposed in Patent Literatures 1 and 2, for example, flat cable waterproofing connectors having waterproofing performance.

LITERATURE OF RELATED ART

Patent Literature

[Patent Literature 1] Japanese Patent Publication No. JP-A-2010-123513

[Patent Literature 2] Japanese Patent Publication No. JP-A-H06-68931

SUMMARY OF INVENTION

Technical Problems

In the flat cable waterproofing connector disclosed in Patent Literature 1, the flat cable is provided with through holes at positions between the conductors, in a region close to a front end of the flat cable in a longitudinal direction, and a mold part formed of synthetic resin and provided with a pulling taper part which is tapered toward the front end of the flat cable is integrally molded over an entire circumference of the flat cable having the through holes.

In the waterproofing connector structure for the flat cable disclosed in Patent Literature 2, a compound terminal body is formed by respectively connecting conductors to conductor connecting parts of a plurality of terminals which are arranged in parallel, and extensively covering the conductor connecting parts with an elastic body. Then, the compound terminal body is inserted into a housing in a cylindrical shape, and a lock projection of the housing is tightly fitted to a bellow part of the elastic body thereby to form a waterproofing connector.

However, in the flat cable waterproofing connector disclosed in Patent Literature 1, the flat cable is provided with the through holes along an entire length of the mold part.

Therefore, when an external force is exerted in a direction where the flat cable is pulled, the external force acts on the entire length of the mold part, thereby to deteriorate a tight fitting force with respect to the flat cable along the entire length of the mold part. As the results, there has been such a problem that the waterproofing performance is deteriorated.

The waterproofing connector structure for the flat cable disclosed in Patent Literature 2 has had such a problem that when an external force is exerted on the flat cable, the elastic body is deformed, and a gap is formed between an inner wall face of the housing and the elastic body, which results in deterioration of waterproofing performance.

SUMMARY

This invention has been made in view of the above described circumstances, and it is an object of the invention to provide a flat cable waterproofing connector in which deterioration of waterproofing performance can be prevented, even in case where a tensile force is exerted on a flat cable.

According to one aspect of the present invention, there is provided a flat cable waterproofing connector, comprising:

a flat cable having an insulating covering part where a conductor wire is covered with an insulating film, a terminal bonded to the conductor wire, and a connector housing which is engaged with a mating connector so that the terminal is connected with a terminal of the mating connector, wherein the flat cable waterproofing connector includes a resin mold part which is integrally molded on an end part in a longitudinal direction of the flat cable so as to cover a bonding part between the conductor wire and the terminal, and the resin mold part has a waterproofing mold part for covering the bonding part, and a holding mold part for covering the flat cable at a deeper side in the longitudinal direction of the flat cable than the waterproofing mold part.

The waterproofing mold part may have a seal part to be tightly fitted to an inner wall face of the connector housing, the holding mold part has such a shape as to be fitted into the connector housing, and the flat cable has at least one of openings which are formed in the insulating covering part at such positions as to be covered with the holding mold part, or a pair of cutouts which are formed in both side end parts opposed to each other in a lateral direction of the insulating covering part and arranged at such positions that at least a part of the cutouts is covered with the holding mold part.

The cutouts may be respectively formed in the side end parts which are opposed to each other in the lateral direction of the insulating covering part, and the holding mold part is formed so as to cover respective one edges of the cutouts in a direction perpendicular to the longitudinal direction of the flat cable.

The flat cable may have a plurality of the conductor wires, and the openings are provided between the respective two conductor wires out of a plurality of the conductor wires.

The seal part may include an annular seal member having elasticity which is provided along an outer periphery of the waterproofing mold part.

According to another aspect of the present invention, there is provided a waterproofing connector structure for a flat cable comprising a flat cable having an insulating covering part where a conductor wire is covered with an insulating film, a terminal bonded to the conductor wire, a resin mold part which is integrally molded on the flat cable for covering a bonding part between the conductor wire and the terminal, and a connector housing which is engaged with a mating connector in such a manner that the terminal is connected with a terminal of the mating connector, from one of both ends of the connector housing opposed to each other, and the resin mold part is inserted into the connector housing from the other end, wherein the structure includes a seal part where an elastic seal member which is so shaped as to follow an outer periphery of the resin mold part so as to be tightly fitted to an inner wall face of the connector housing is provided, and a holding part which is arranged remote from a terminal connecting end of the flat cable, as compared with the seal part in the longitudinal direction, and has such a shape as to be fitted into the connector housing, thereby to hold the flat cable.

The seal part may have a seal member holding part in a form of a groove which is formed along an outer periphery of the seal part, and the elastic seal member is formed in an annular shape, and fitted into the seal member holding part.

The connector housing may have a guiding cutout in a shape of a rectangular cutout, which is formed in an upper wall of the connector housing from an open edge at a side where the resin mold part is inserted to an interior of the upper wall, and the holding part has an upper protuberance which is projected from an upper face of the holding part, wherein when the resin mold part is inserted into the connector housing, the upper protuberance is guided by the guiding cutout.

Advantage of the Invention

The flat cable waterproofing connector according to the present invention has a resin mold part which is integrally molded on an end part in the longitudinal direction of the flat cable so as to cover the bonding part between the conductor wires and the terminals, and the resin mold part includes the waterproofing mold part for covering the bonding part, and the holding mold part for covering the flat cable at the deeper side in the longitudinal direction of the flat cable than the waterproofing mold part. Therefore, a tensile force is likely to be exerted on the holding mold part. On the other hand, the tensile force is unlikely to be exerted on the waterproofing mold part. As the results, peeling off of the waterproofing mold part from the flat cable is prevented, and consequently, deterioration of the waterproofing performance can be prevented, even in case where the tensile force is exerted on the flat cable.

In the flat cable waterproofing connector according to the present invention, the waterproofing mold part has the seal part to be tightly fitted to the inner wall face of the connector housing, the holding mold part has such a shape as to be fitted into the connector housing, and the flat cable has openings which are formed in the insulating covering part and arranged at such positions as to be covered with the holding mold part, or a pair of cutouts which are formed in both end parts opposed to each other in the lateral direction of the insulating covering part and arranged at such positions that at least a part of the cutouts is covered with the holding mold part. Therefore, the resin for forming the holding mold part is filled in the openings or in the cutouts. This resin which has been filled enables the flat cable to be held by the holding mold part against the tensile force. For this reason, the tensile force is more likely to be exerted on the holding mold part, while the tensile force is more unlikely to be exerted on the waterproofing mold part. As the results, peeling off of the waterproofing mold part from the flat cable is prevented, and consequently, deterioration of the waterproofing performance can be prevented, even in case where the tensile force is exerted on the flat cable.

In the flat cable waterproofing connector according to the present invention, a pair of the cutouts are the cutouts in a rectangular shape which are formed in the side end parts opposed to each other in the lateral direction of the insulating covering part, in such a manner that the holding mold part covers the one edges out of the edges defining the respective cutouts in the direction perpendicular to the longitudinal direction of the flat cable. Therefore, the one edges of the respective cutouts which are covered with the holding mold part function as the parts to be hooked on the holding mold part, and hence, the flat cable can be more stably held by the holding mold part against the tensile force.

In the flat cable waterproofing connector according to the present invention, the flat cable has a plurality of the conductor wires, and the openings are respectively provided between the two conductor wires of a plurality of the conductor wires. As the results, it is possible to efficiently arrange the openings.

In the flat cable waterproofing connector according to the present invention, the seal part is the annular seal member having elasticity which is provided along the outer periphery of the waterproofing mold part. Therefore, the waterproofing mold part can be reliably tight-fitted to the inner wall face of the connector housing, and consequently, the waterproofing performance can be enhanced.

The waterproofing connector structure for the flat cable according to the present invention includes the seal part where the elastic seal member which is so shaped as to follow the outer periphery of the resin mold part so as to be tightly fitted to the inner wall face of the connector housing is provided, and the holding part which is arranged remote from the terminal connecting end of the flat cable, as compared with the seal part in the longitudinal direction, and has such a shape as to be fitted into the connector housing, thereby to hold the flat cable. Because waterproofing performance is given by the elastic seal member which is provided in the seal part, and the resin mold part has higher rigidity than the elastic seal member and is unlikely to be deformed, a gap hardly occurs between the inner wall face of the connector housing and the elastic seal member. Consequently, deterioration of waterproofing performance can be prevented, even in case where an external force is exerted on the flat cable.

In the waterproofing connector structure for the flat cable according to the present invention, by attaching the resin mold part to the connector housing, the terminal which is bonded to the conductor wire is contained in the connector housing. Therefore, there is no necessity of assembling a relay terminal for connecting the terminal to the conductive wire into the connector housing. As the results, assembling work can be facilitated.

In the waterproofing connector structure for the flat cable according to the present invention, the resin mold part can be easily inserted into the connector housing, because the resin mold part has higher rigidity than the elastic seal member, and is unlikely to be deformed.

In the waterproofing connector structure for the flat cable according to the present invention, the seal part has the seal member holding part in a form of a groove which is formed along the outer periphery of the seal part, and the elastic seal member is in an annular shape, and fitted into the seal member holding part. Therefore, the elastic seal member is held so as not to be easily deformed, and consequently, the waterproofing performance can be enhanced.

In the waterproofing connector structure for the flat cable according to the present invention, the connector housing has the guiding cutout in a shape of a rectangular cutout which is formed in the upper wall of the connector housing, from the open edge at a side where the resin mold part is inserted to the interior of the upper wall, and the holding part has the upper protuberance which is projected from the upper face of the holding part. When the resin mold part is inserted into the connector housing, the upper protuberance is guided by the guiding cutout, and therefore, the resin mold part can be easily inserted into the connector housing.

DETAILED DESCRIPTION OF EMBODIMENTS

First Embodiment

Figure 1:
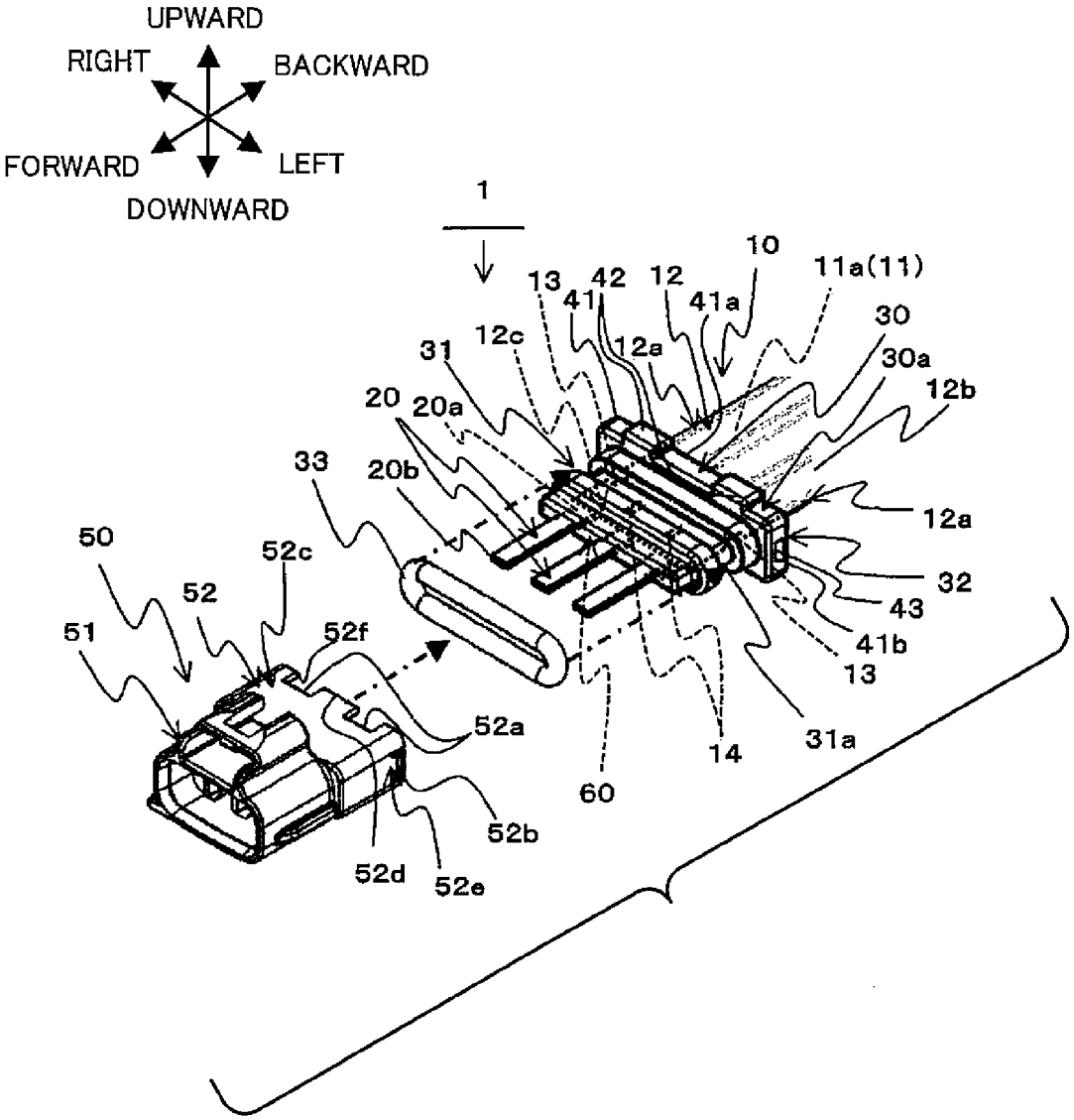
FIG. 1 is an exploded perspective view of a flat cable waterproofing connector according to the first embodiment of the present invention.

Now, referring to the drawings, the flat cable waterproofing connector according to the first embodiment of the present invention will be described in detail.

Figure 2:
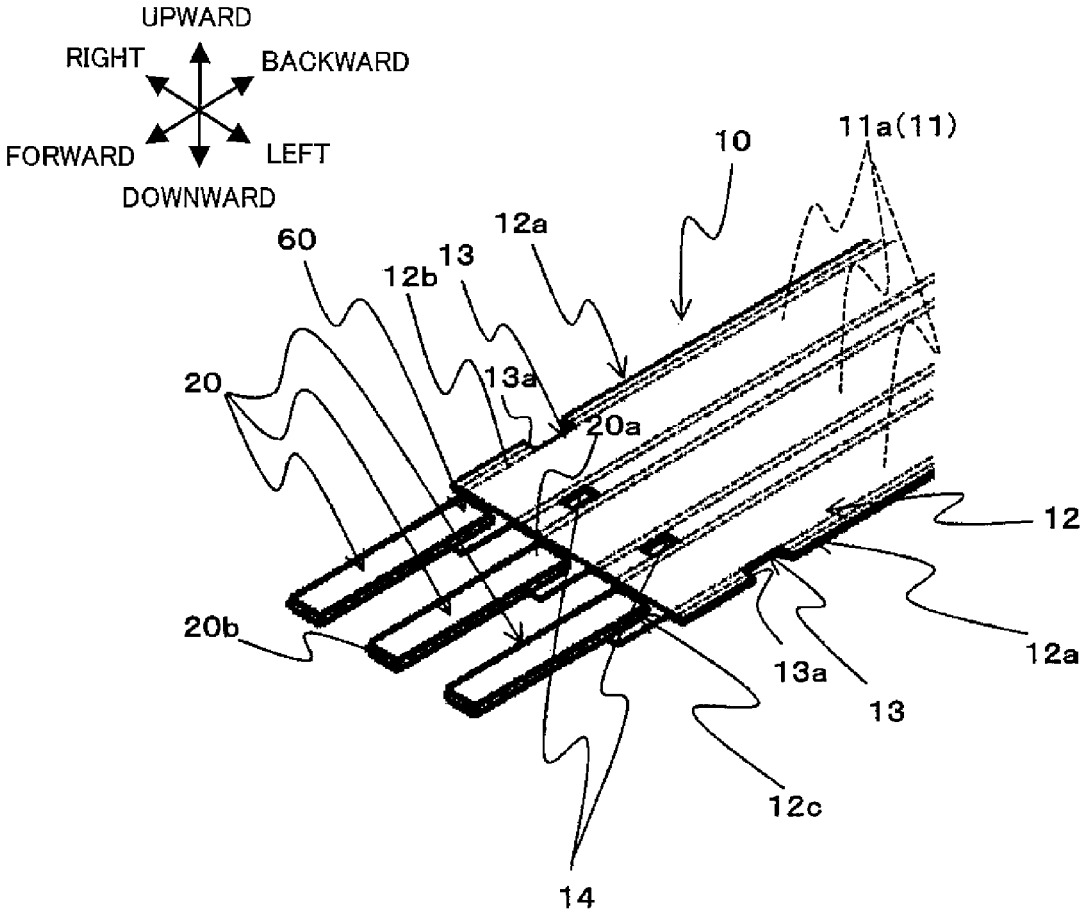
FIG. 2 is a perspective view of the flat cable as shown in FIG. 1, and terminals which are bonded to the flat cable.
Figure 3:
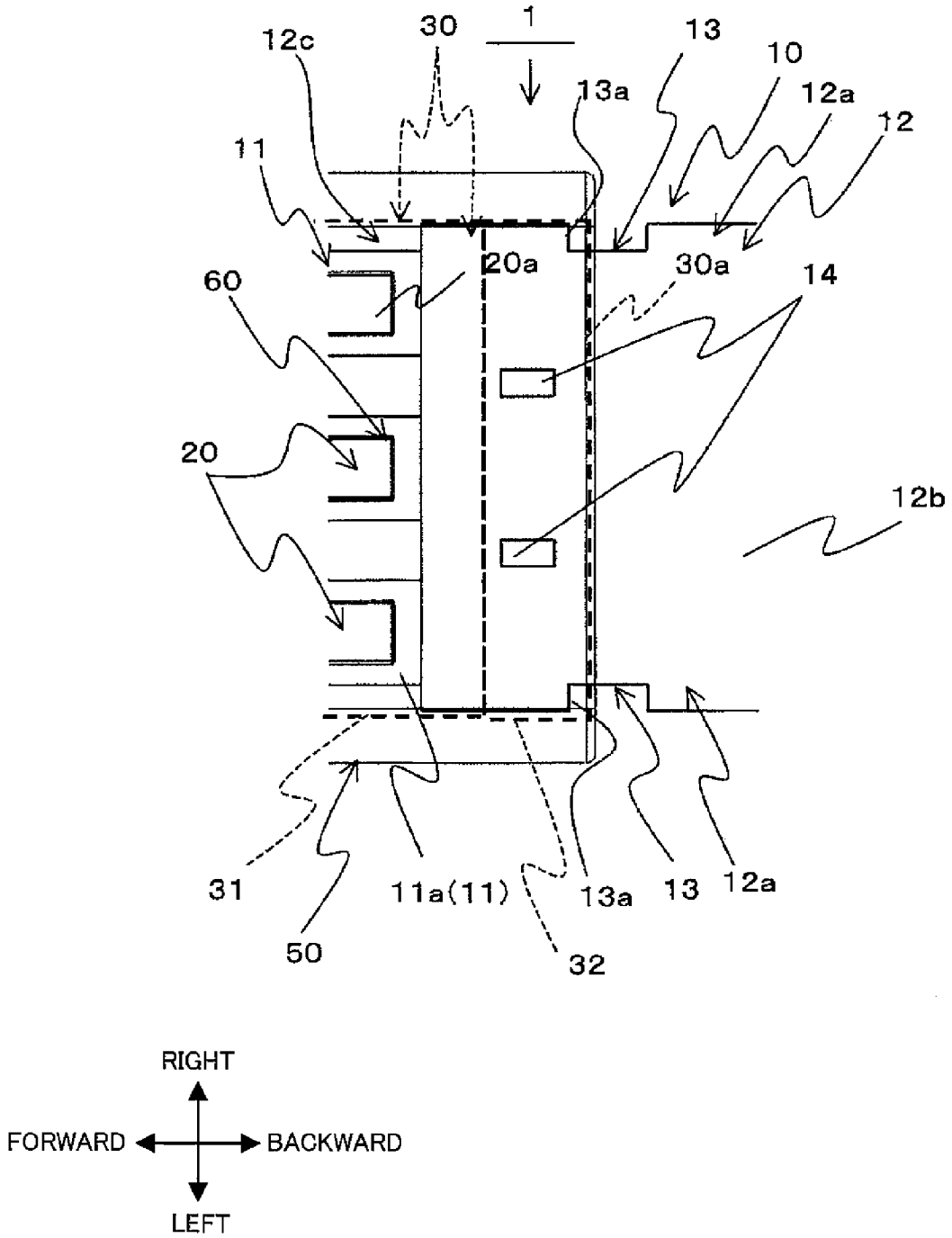
FIG. 3 is a plan view of an essential part of the flat cable waterproofing connector as shown in FIG. 1.

FIG. 1 is an exploded perspective view of a flat cable waterproofing connector 1 according to the first embodiment of the present invention. FIG. 2 is a perspective view of a flat cable 10 as shown in FIG. 1, and terminals 20 which are bonded to the flat cable 10. FIG. 3 is a plan view of an essential part of the flat cable waterproofing connector 1 as shown in FIG. 1.

For convenience of explanation, arrow marks intersecting each other in the drawings represent forward and backward directions, right and left directions, and upward and downward directions.

The flat cable waterproofing connector 1 includes the flat cable 10, the three terminals 20, a resin mold part 30, and a connector housing 50, as shown in FIG. 1.

To begin with, the flat cable 10 will be described referring to FIG. 2.

The flat cable 10 has a conductor part 11 and an insulating covering part 12.

The conductor part 11 has three pieces of conductive wires 11*a* formed of copper or copper alloy, and having flexibility. These three conductive wires 11*a* are provided in parallel, according to intervals of the terminals 20 which are arranged in parallel.

Although the conductor part 11 having the three conductor wires 11*a* is described, as an example, in this embodiment, the invention is not limited to the case. Specifically, it would be sufficient that the number of the conductor wires 11*a* is one or more.

The insulating covering part 12 is formed by covering the conductor part 11 with an insulating film 12*b* formed of polypropylene or the like.

This insulating covering part 12 has a pair of cutouts 13 and a pair of openings 14. The cutouts 13 are the cutouts in a rectangular shape which are positioned in both side end parts 12*a* opposed to each other in a lateral direction of the insulating covering part 12, in such a manner that at least a part of the cutouts are covered with a holding mold part 32 which will be described below. More specifically, one edge 13*a* of each of the cutouts 13 in a direction perpendicular to the longitudinal direction of the flat cable 10 is covered with the holding mold part 32.

The openings 14 are formed in the insulating covering part 12, and arranged at such positions as to be covered with a holding part, which will be described below. In this embodiment, the openings 14 are formed between the respective two conductor wires 11*a* out of the three conductor wires 11*a*, that is, at two positions in total.

The flat cable 10 as described above has flexibility because the conductor part 11 is covered with the insulating film 12*b* into a shape of a flat plate, as shown in FIG. 2. Moreover, the insulating film 12*b* is removed from an end part 12*c* in the longitudinal direction of the flat cable 10, which is the end part at a side to be connected with the terminals 20, thereby to expose the respective conductor wires 11*a*. The terminals 20 are respectively bonded to the conductor wires 11*a* which are thus exposed.

Then, the three terminals 20 will be described.

Each of the three terminals 20 has a shape corresponding to each of the conductor wires 11*a*, and bonded to the conductor wire 11*a* by ultrasonic welding, press fitting, etc. In this embodiment, the terminals 20 are male type terminals, and their end parts 20*b* at an opposite side to end parts 20*a* which are bonded to the conductor wires 11*a* are connected to terminals of a mating connector, which are not shown.

Although a case where the flat cable waterproofing connector 1 has the three terminals 20 has been described, as an example, in this embodiment, the invention is not limited to the case. Specifically, it would be sufficient that the number of the terminals 20 to be provided may correspond to the number of the conductor wires 11*a*.

Then, the connector housing 50 will be described.

The mating connector, which is not shown, is engaged with the connector housing 50, from one end of opposite ends of the connector housing 50 in such a manner that the terminals 20 and the terminals of the mating connector, which are not shown, are connected with each other, and the resin mold part 30 is inserted from the other end of the connector housing 50.

The connector housing 50 has a first engaging part 51 to be engaged with the mating connector, which is not shown, and a second engaging part 52 to be engaged with the resin mold part 30.

The first engaging part 51 is formed in a cylindrical shape having an oblong outer shape in cross section so that the mating connector, which is not shown, may be fitted into the interior. Specifically, by fitting the mating connector, which is not shown, into the first engaging part 51, the terminals 20 are connected with the terminals of the mating connector, which are not shown.

The second engaging part 52 is formed in a cylindrical shape having a rectangular outer shape in cross section so that the resin mold part 30 may be fitted into the interior. This second engaging part 52 has guiding cutouts 52*a* and housing openings 52*b*.

The guiding cutouts 52*a* are the cutouts in a rectangular shape which are formed in an upper wall 52*c* of the second engaging part 52 from an open edge 52*d* to an interior of the upper wall 52*c*. These guiding cutouts 52*a* are formed at two positions of the upper wall 52*c* of the second engaging part 52. The guiding cutouts 52*a* are adapted to guide upper protuberances 42 of the resin mold part 30, which will be described below, when the resin mold part 30 is inserted into the connector housing 50.

The housing openings 52*b* are a pair of openings which are formed in both side walls 52*e* of the second engaging part 52. These housing openings 52*b* are adapted to be engaged with side protuberances 43 of the resin mold part 30, which will be described below.

The connector housing 50 which has such a shape that the first engaging part 51 is formed in a cylindrical shape having an oblong outer shape in cross section, and the second engaging part 52 is formed in a cylindrical shape having a rectangular outer shape in cross section has been described, as an example. However, the invention is not limited to the case. Other shapes may be adopted, provided that the mating connector, which is not shown, is engaged with the connector housing 50 from one of the opposite ends in such a manner that the terminals 20 are connected with the terminals of the mating connector, which are not shown, and the resin mold part 30 is inserted from the other end.

Then, the resin mold part 30 will be described.

The resin mold part 30 is integrally molded on the end part 12*c* in the longitudinal direction of the flat cable 10 so as to cover a bonding part 60 between the conductor wires 11*a* and the terminals 20.

This resin mold part 30 has a waterproofing mold part 31 which covers the bonding part 60, and a holding mold part 32 which covers the flat cable 10 at a deeper side in the longitudinal direction of the flat cable than the waterproofing mold part 31. Namely, the deeper side of the flat cable 10 means that the position is farther from the end part 12*c* of the flat cable 10.

The waterproofing mold part 31 has a seal member holding part 31*a*.

The seal member holding part 31*a* is a groove formed along an outer periphery of the waterproofing mold part 31, and an annular seal member 33 formed of rubber material or so and having elasticity is fitted into the seal member holding part 31*a*. The annular seal member 33 is tightly fitted to an inner wall face 52*f* of the connector housing 50 thereby to block the connector housing 50 with respect to the waterproofing mold part 31 in tight seal.

The holding mold part 32 is a part for holding the flat cable 10. This holding mold part 32 has such a shape as capable of being fitted into the connector housing 50. More specifically, the holding mold part 32 has a flange-shaped wall 41 uprightly provided along a backward end edge 30*a* of the resin mold part 30 and having a rectangular outer shape in cross section, the upper protuberances 42 which are projected from two positions of upper edge face 41*a* of the flange-shaped wall 41, and a pair of the side protuberances 43 which are projected from both side edge faces 41*b* of the flange-shaped wall 41.

Each of the two upper protuberances 42 has a substantially cubic shape corresponding to each of the guiding cutouts 52*a* of the connector housing 50. These upper protuberances 42 are respectively guided by the guiding cutouts 52*a* thereby to position the resin mold part 30 to be inserted into the connector housing 50.

Each of a pair of the side protuberances 43 is formed substantially in a shape of a lance, and adapted to be engaged with each of the housing openings 52*b* of the housing 50. When the side protuberances 43 and the housing openings 52*b* are engaged with each other, the resin mold part 30 is fixed at a predetermined position inside the connector housing 50. Specifically, by engaging the side protuberances 43 with the housing openings 52*b*, it is possible to fix the resin mold part 30 at the predetermined position inside the connector housing 50.

Moreover, the holding mold part 32 is so formed as to cover the openings 14 which are provided at two positions of the flat cable 10, as shown in FIG. 3. Further, the holding mold part 32 is so formed as to cover the respective one edges 13*a* of the cutouts 13 in the direction perpendicular to the longitudinal direction of the flat cable 10.

In this manner, the holding mold part 32 covers the flat cable 10 at the deeper side than the waterproofing mold part 31 in the longitudinal direction of the flat cable 10. Therefore, a tensile force is likely to be exerted on the holding mold part 32. On the other hand, the tensile force is unlikely to be exerted on the waterproofing mold part 31.

Moreover, because the two openings 14 are provided at the positions to be covered with the holding mold part 32, the resin for forming the holding mold part 32 is filled in the openings 14. This resin which has been filled enables the flat cable 10 to be held by the holding mold part 32 against the tensile force. For this reason, the tensile force is more likely to be exerted on the holding mold part 32, while the tensile force is more unlikely to be exerted on the waterproofing mold part 31.

Moreover, the resin is formed in such a manner that the holding mold part 32 covers the respective one edges 13*a* out of the edges defining the cutouts 13 in the direction perpendicular to the longitudinal direction of the flat cable 10. Therefore, the one edges 13*a* of the cutouts 13 which are covered with the holding mold part 32 function as those parts to be hooked on the holding mold part 32, and hence, the flat cable 10 can be held by the holding mold part 32 against the tensile force.

Now, referring to FIGS. 4A to 4C, 5A and 5B, a method of producing the flat cable waterproofing connector 1 will be described. FIGS. 4A to 4C, 5A and 5B are views showing the method of producing the flat cable waterproofing connector 1, as shown in FIG. 1.

As a first step, a worker removes the insulating film 12*b* from the end part 12*c* in the longitudinal direction of the flat cable 10 thereby to expose the end parts of the respective conductor wires 11*a*. Then, the end parts of the conductor wires 11*a* which have been thus exposed and the terminals 20 are bonded to each other, by ultrasonic welding or press fitting, etc. (See FIG. 4A).

Figure 4A:
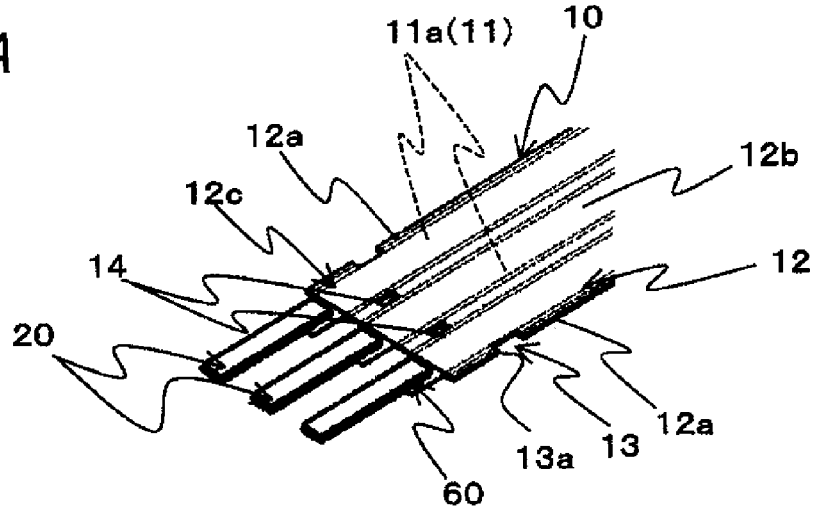
FIGS. 4A to 4C are views showing a method of producing the flat cable waterproofing connector as shown in FIG. 1.
Figure 4B:
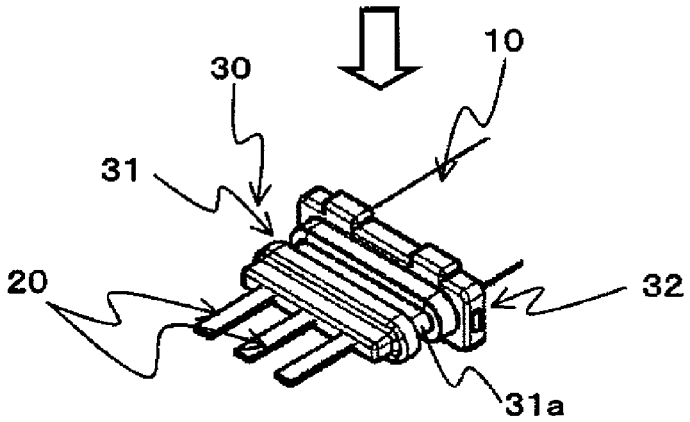

Thereafter, the worker integrally molds the resin mold part 30 on the end part 12*c* in the longitudinal direction of the flat cable 10 so as to cover the bonding part 60 between the conductor wires 11*a* and the terminals 20 (See FIG. 4B). Because the resin mold part 30 is integrally molded on the end part 12*c* of the flat cable 10 in the longitudinal direction, the resin forming the holding mold part 32 is filled in the openings 14, and covers the one edges 13*a* in the direction perpendicular to the longitudinal direction of the flat cable 10, out of the edges defining the cutouts 13.

Figure 4C:
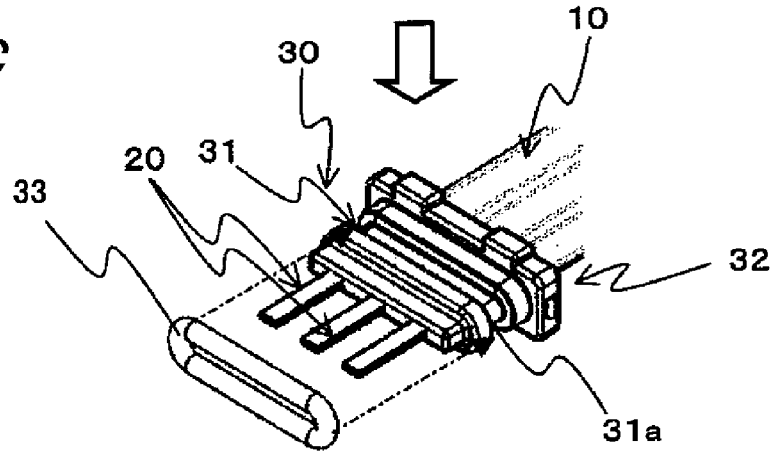
Figure 4C:
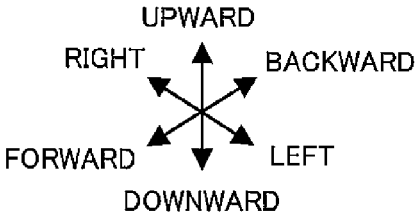

Then, the worker fits the annular seal member 33 into the seal member holding part 31*a* (See FIG. 4C).

Figure 5A:
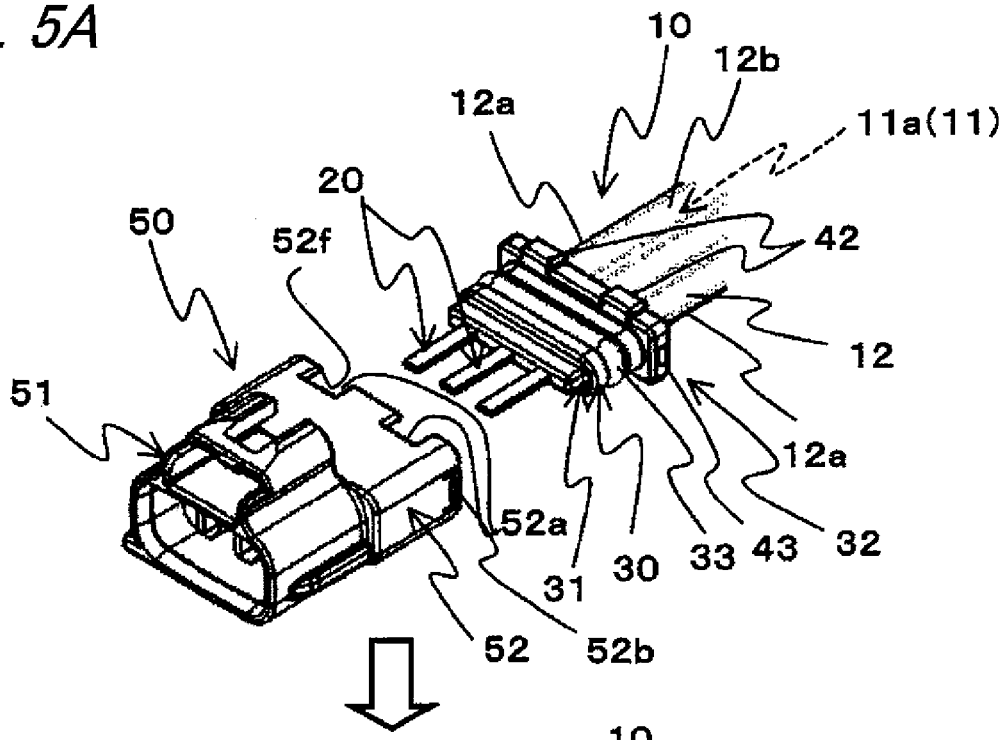
FIGS. 5A and 5B are views showing the method of producing the flat cable waterproofing connector as shown in FIG. 1.

Thereafter, the worker inserts the resin mold part 30 into the connector housing 50 (See FIG. 5A). On occasion of inserting the resin mold part 30 into the connector housing 50, the upper protuberances 42 are guided by the guiding cutouts 52*a* thereby to position the resin mold part 30 to be inserted into the connector housing 50.

Figure 5B:
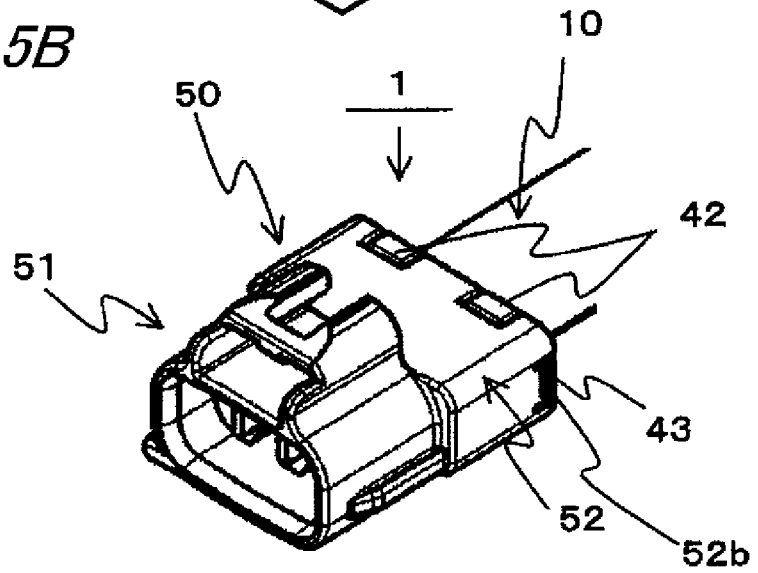
Figure 5B:
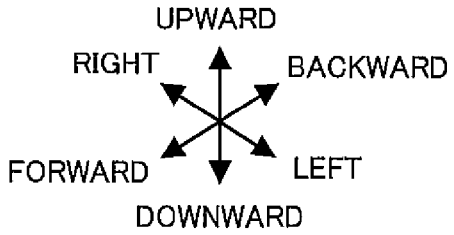

Then, the worker allows the housing openings 52*b* to be respectively engaged with the side protuberances 43 of the resin mold part 30 (See FIG. 5B). In this manner, the flat cable waterproofing connector is completed. By attaching the flat cable 10 to the connector housing 50, as described above, the waterproofing mold part 31 is tightly fitted to the inner wall face 52*f* of the connector housing 50 by means of the annular seal member 33, and the holding mold part 32 is fitted into the connector housing 50 thereby to hold the flat cable 10.

The flat cable waterproofing connector 1 according to the first embodiment of the present invention has the resin mold part 30 which is integrally molded on the end part 12*c* in the longitudinal direction of the flat cable 10 so as to cover the bonding part 60 between the conductor wires 11*a* and the terminals 20, and the resin mold part 30 includes the waterproofing mold part 31 for covering the bonding part 60, and the holding mold part 32 for covering the flat cable 10 at the deeper side in the longitudinal direction of the flat cable 10 than the waterproofing mold part 31. Therefore, a tensile force is likely to be exerted on the holding mold part 32. On the other hand, the tensile force is unlikely to be exerted on the waterproofing mold part 31. As the results, peeling off of the waterproofing mold part 31 from the flat cable 10 is prevented, and consequently, deterioration of the waterproofing performance can be prevented, even in case where the tensile force is exerted on the flat cable 10.

Moreover, in the flat cable waterproofing connector 1 according to the first embodiment of the present invention, the waterproofing mold part 31 has the annular seal member 33 to be tightly fitted to the inner wall face 52*f* of the connector housing 50, the holding mold part 32 has such a shape as to be fitted into the connector housing 50, and the flat cable 10 has the openings 14 which are formed in the insulating covering part 12 and arranged at such positions as to be covered with the holding mold part 32, or a pair of the cutouts 13 which are formed in both side end parts opposed to each other in the lateral direction of the insulating covering part 12 and arranged at the positions where at least a part of the cutouts is covered with the holding mold part 32. Therefore, the resin for forming the holding mold part 32 is filled in the openings 14 or in the cutouts 13. This resin which has been filled enables the flat cable 10 to be held by the holding mold part 32 against the tensile force. For this reason, the tensile force is more likely to be exerted on the holding mold part 32. On the other hand, the tensile force is more unlikely to be exerted on the waterproofing mold part 31. As the results, peeling off of the waterproofing mold part 31 from the flat cable 10 is prevented, and consequently, deterioration of the waterproofing performance can be prevented, even in case where the tensile force is exerted on the flat cable 10.

Moreover, in the flat cable waterproofing connector 1 according to the first embodiment of the present invention, a pair of the cutouts 13 are the cutouts in a rectangular shape which are formed in the side end parts 12*a* opposed to each other in the lateral direction of the insulating covering part 12, in such a manner that the holding mold part 32 covers the one edges 13*a* out of the edges defining the respective cutouts 13 in the direction perpendicular to the longitudinal direction of the flat cable 10. Therefore, the one edges 13*a* of the respective cutouts 13 which are covered with the holding mold part 32 function as the parts to be hooked on the holding mold part 32, and hence, the flat cable 10 can be more stably held by the holding mold part 32 against the tensile force.

Moreover, in the flat cable waterproofing connector 1 according to the first embodiment of the present invention, the flat cable 10 has the three conductor wires 11*a*, and the openings 14 are respectively provided between the two conductor wires 11*a* of the three conductor wires 11*a*. As the results, it is possible to efficiently arrange the openings 14.

Moreover, in the flat cable waterproofing connector 1 according to the first embodiment of the present invention, the annular seal member 33 having elasticity is provided along the outer periphery of the waterproofing mold part 31, and therefore, the waterproofing mold part 31 can be reliably tight-fitted to the inner wall face 52*f* of the connector housing 50. As the results, the waterproofing performance can be enhanced.

(Modification)

Figure 6:
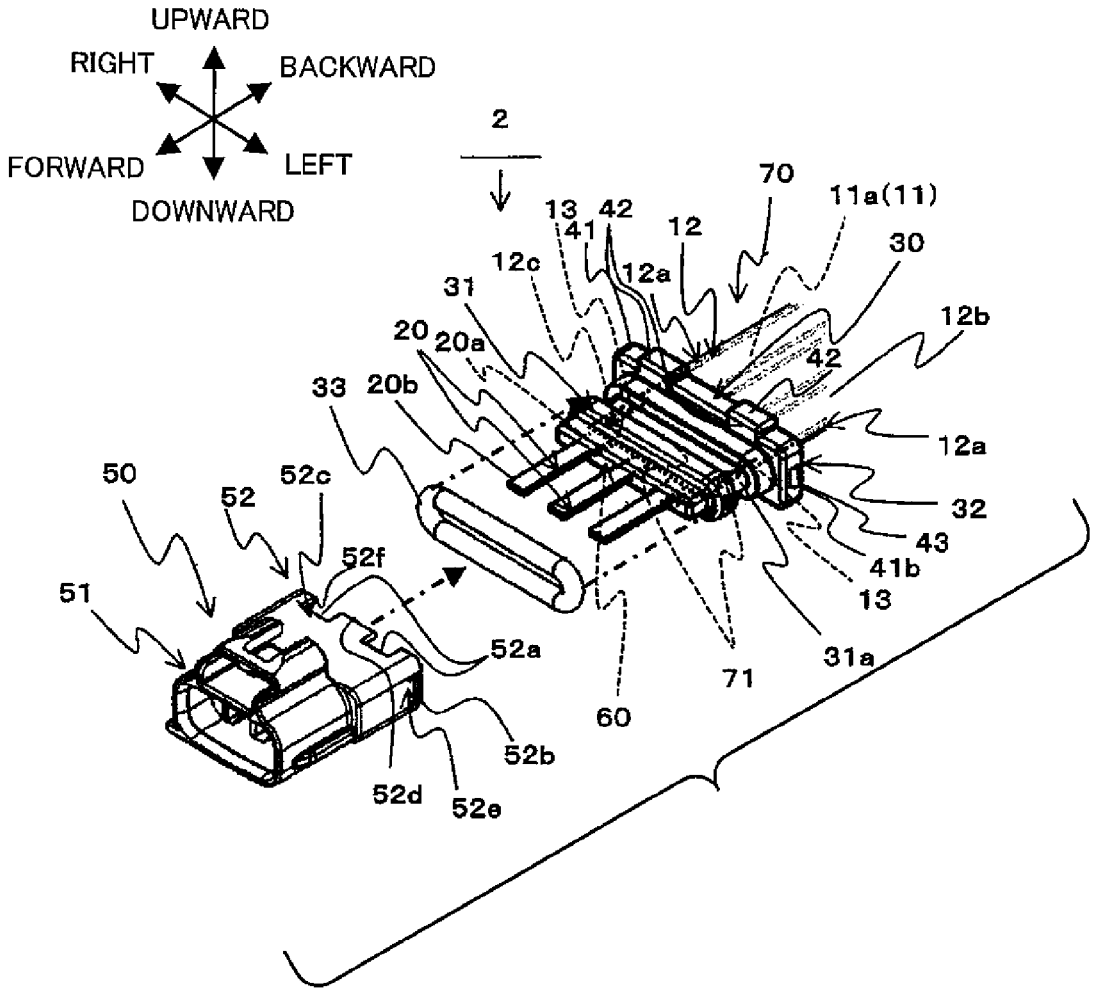
FIG. 6 is an exploded perspective view of a flat cable waterproofing connector in a modification of the first embodiment according to the present invention.
Figure 7:
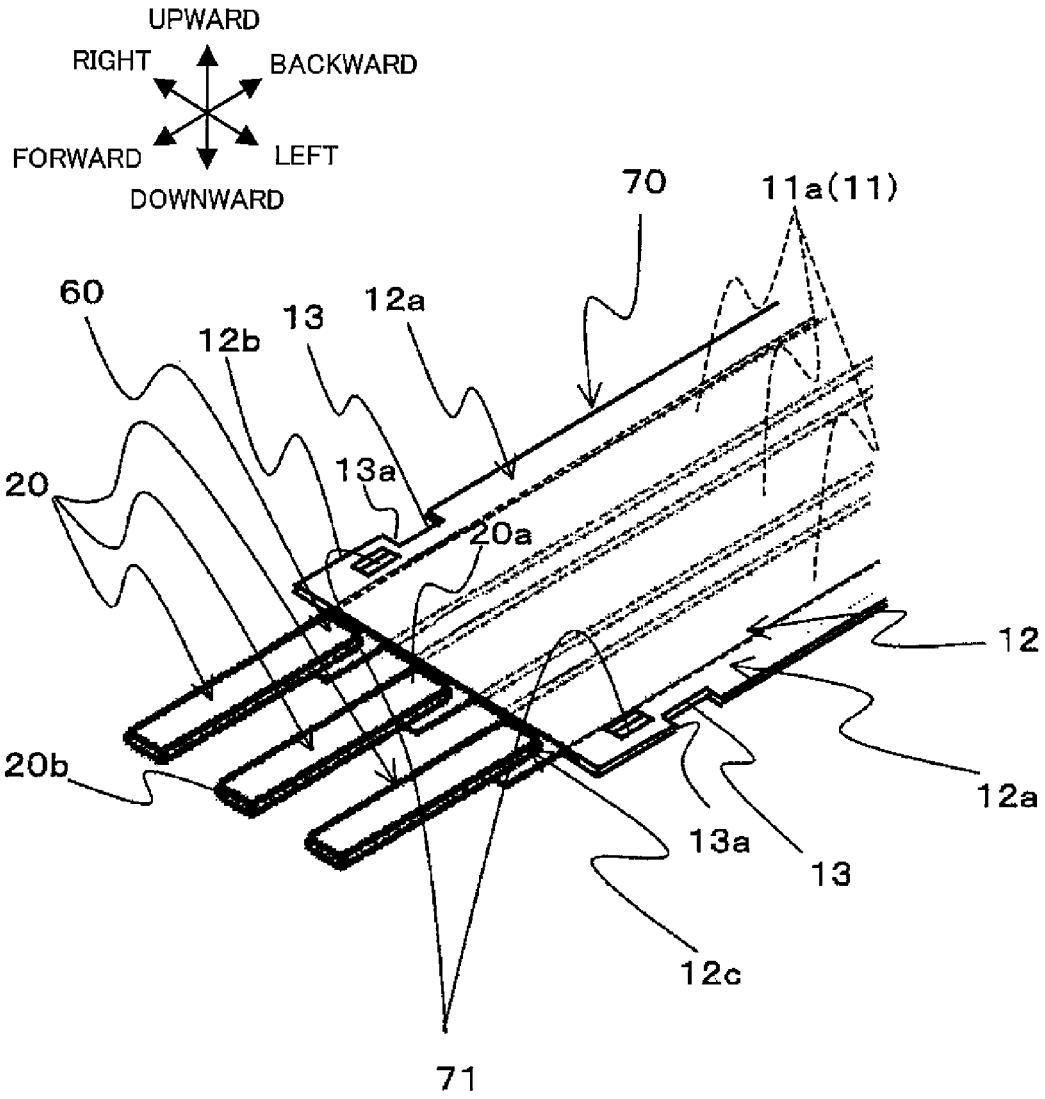
FIG. 7 is a perspective view of the flat cable as shown in FIG. 6, and terminals which are bonded to the flat cable.

Now, referring to FIGS. 6 and 7, a modification of the first embodiment according to the present invention will be described. FIG. 6 is an exploded perspective view of a flat cable waterproofing connector 2 in the modification of the first embodiment according to the present invention. FIG. 7 is a perspective view of a flat cable 70 as shown in FIG. 6, and terminals 20 which are bonded to the flat cable 70.

The flat cable waterproofing connector 1 in which the two openings 14 in total are provided, that is, one each between the two conductor wires 11*a* has been described, as an example, in the first embodiment of the present invention. However, the flat cable waterproofing connector 2 in this modification is different from the flat cable waterproofing connector 1 in the embodiment in that openings 71 are provided in both the side end parts 12*a* opposed to each other in the lateral direction of the insulating covering part 12.

It is to be noted that other structures are substantially the same as those of the embodiment, and the same components as in the embodiment are denoted with the same reference numerals.

In the flat cable waterproofing connector 2 as described above, the openings 71 are arranged at such positions as to be covered with the holding mold part 32. Therefore, the resin for forming the holding mold part 32 is filled in the respective openings 71, and this resin which has been filled enables the flat cable 10 to be held by the holding mold part 32 against the tensile force. As the results, substantially the same advantage as the first embodiment can be attained.

Moreover, in the flat cable waterproofing connectors 1 and 2 which have been described, as the examples, in the first embodiment of the present invention, the holding mold part 32 has the flange-shaped wall 41 having a rectangular outer shape in cross section, which is uprightly provided along the backward end edge 30*a* of the resin mold part 30, the upper protuberances 42 which are projected from the two positions of the upper edge face 41*a* of the flange-shaped wall 41, and a pair of the side protuberances 43 which are projected from the both the side edge faces 41*b* of the flange-shaped wall 41. However, the invention is not limited to the case. Specifically, other shapes may be adopted, provided that the holding mold part 32 is positioned remote from the end part 12*c* in the longitudinal direction of the flat cable 10 as compared with the waterproofing mold part 31 in the longitudinal direction of the flat cable 10, 70 and has such a shape as to be fitted into the connector housing 50 thereby to hold the flat cable 10, 70.

Moreover, in the flat cable waterproofing connectors 1 and 2 which have been described, as the examples, in the first embodiment of the present invention, the flat cable 10, 70 has the cutouts 13 and the openings 14, 71. However, the invention is not limited to the case. Specifically, it would be sufficient that the flat cable 10, 70 can be held by the holding mold part 32.

Moreover, in the flat cable waterproofing connectors 1 and 2 which have been described, as the examples, in the first embodiment of the present invention, the cutouts 13 in a rectangular shape are provided. However, the invention is not limited to the case, but the cutouts having other shapes may be provided. For example, the cutouts may have a U-shape.

In the flat cable waterproofing connectors 1 and 2 which have been described, as the examples, in the first embodiment of the present invention, a part of the cutouts 13 is covered with the holding mold part 32. However, the invention is not limited to the case. For example, an entirety of the cutouts 13 may be covered with the holding mold part 32. In this case, the resin of the holding mole part 32 which is filled in the cutouts 13 functions for enabling the flat cable 10, 70 to be held by the holding mold part 32 against the tensile force.

In the flat cable waterproofing connectors 1 and 2 which have been described, as the examples, in the first embodiment of the present invention, the two openings 14, 71 in total, that is, one each between the two conductor wires 11*a* are provided. However, the number of the openings 14, 17 is not limited to the case. Specifically, it would be sufficient that the opening 14, 17 may be provided at least in one position. For example, the opening 14, 17 may be provided only at one position between the conductor wires 11*a*.

In the flat cable waterproofing connectors 1 and 2 which have been described, as the examples, in the first embodiment of the present invention, the annular seal member 33 is fitted into the seal member holding part 31*a* which is formed along the outer periphery of the waterproofing mold part 31. However, the invention is not limited to the case. Specifically, it would be sufficient that the waterproofing mold part 31 has only to may have the waterproofing function. For example, the annular seal member 33 need not be provided, provided that the waterproofing mold part 31 is formed of such material as capable of being filled in a gap.

Second Embodiment

Now, referring to the drawings, the waterproofing connector structure for the flat cable according to the second embodiment of the present invention will be described in detail.

Figure 8:
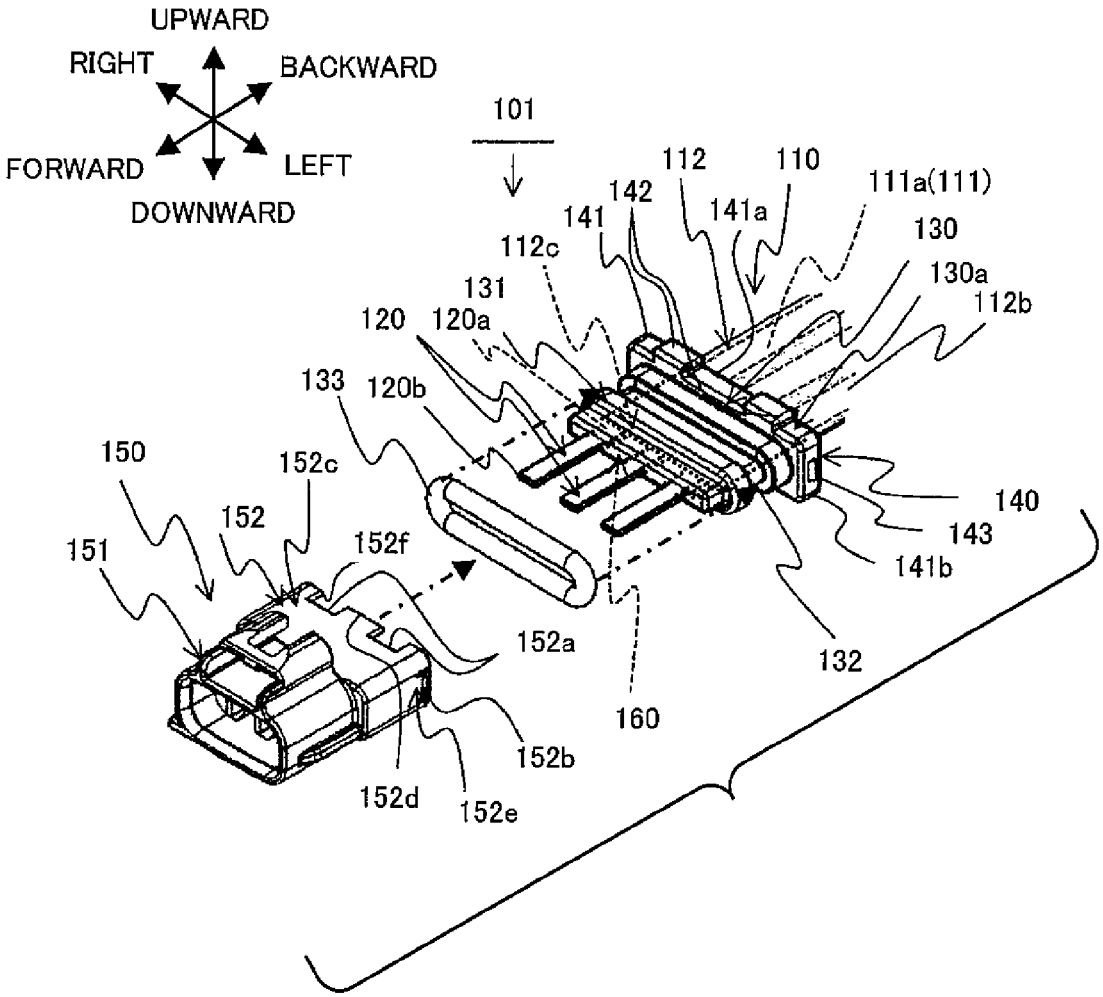
FIG. 8 is an exploded perspective view of a waterproofing connector structure for a flat cable according to the second embodiment of the present invention.
Figure 9:
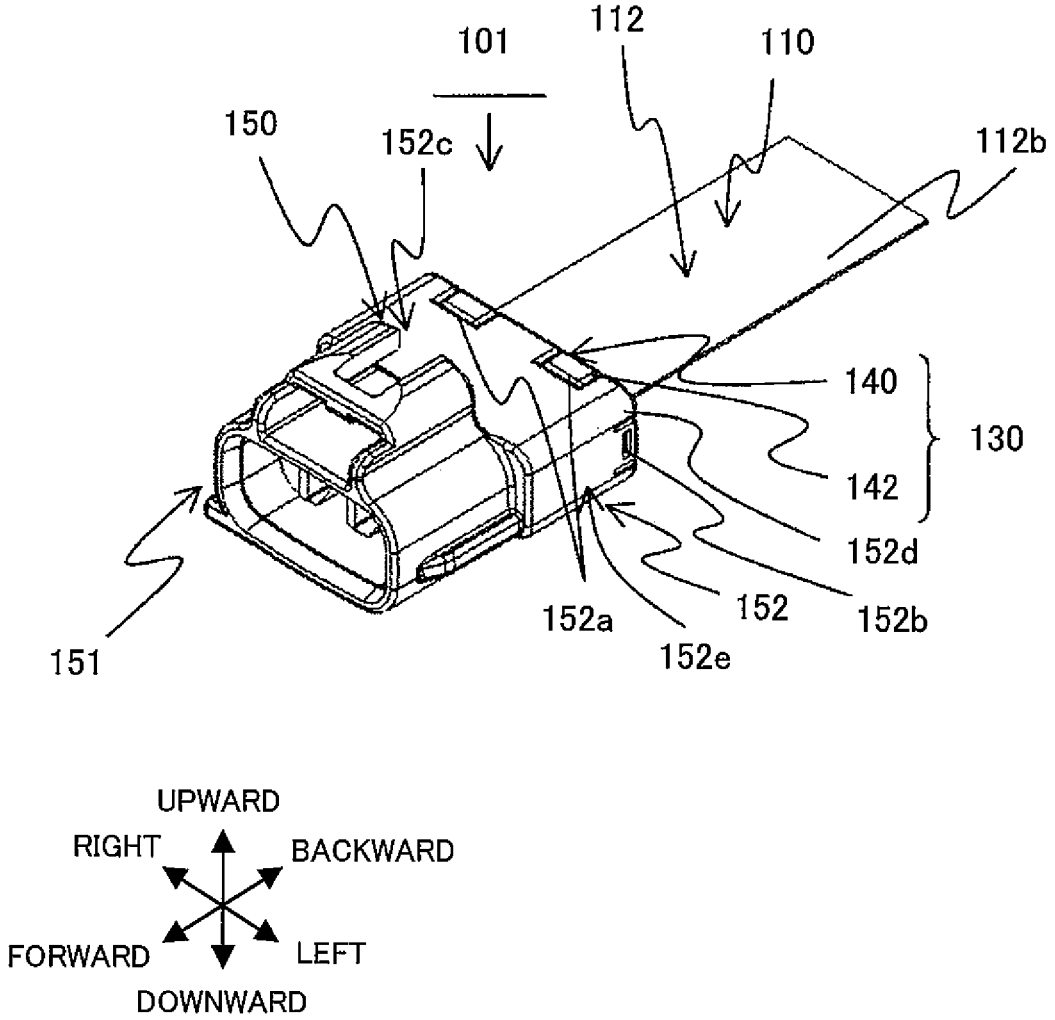
FIG. 9 is a perspective view of the waterproofing connector structure for the flat cable as shown in FIG. 8.
Figure 10:
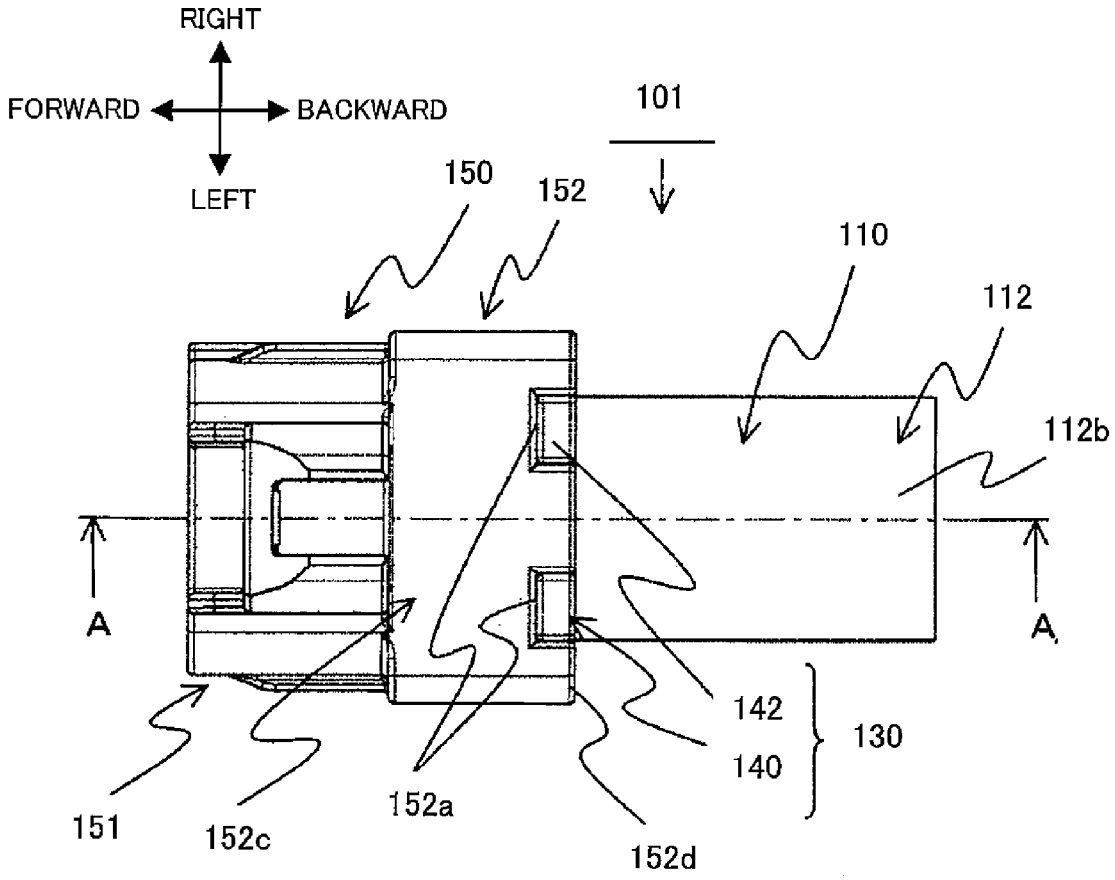
FIG. 10 is a plan view of the waterproofing connector structure for the flat cable as shown in FIG. 8.
Figure 11:
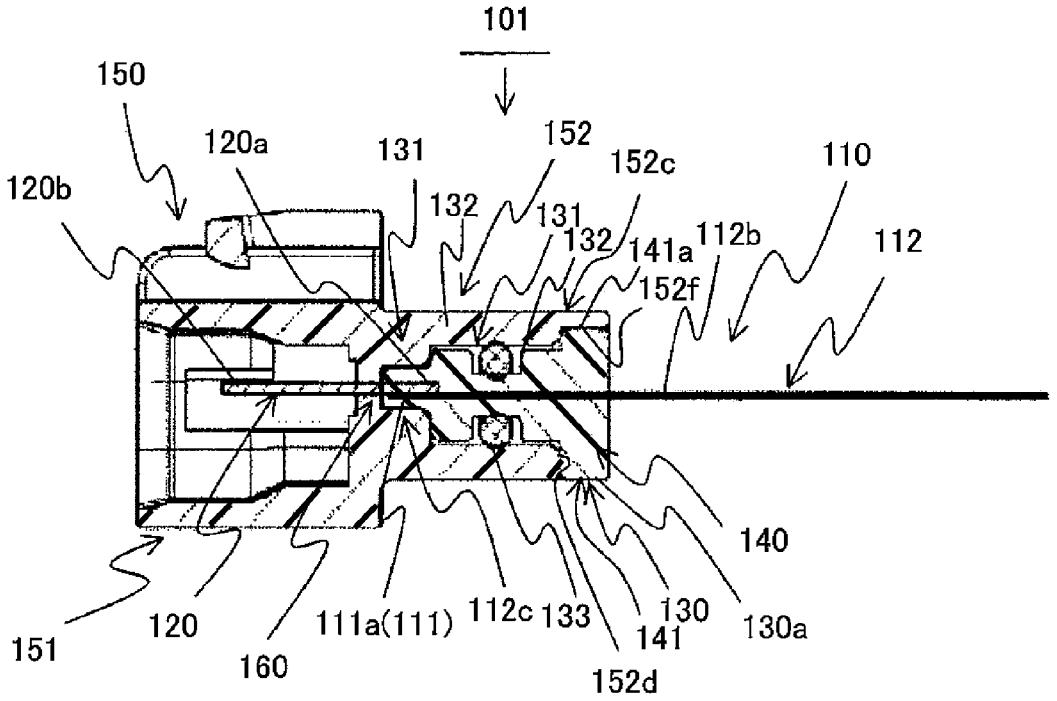
FIG. 11 is a sectional view of the waterproofing connector structure for the flat cable taken along a line A-A in FIG. 10.
Figure 12:
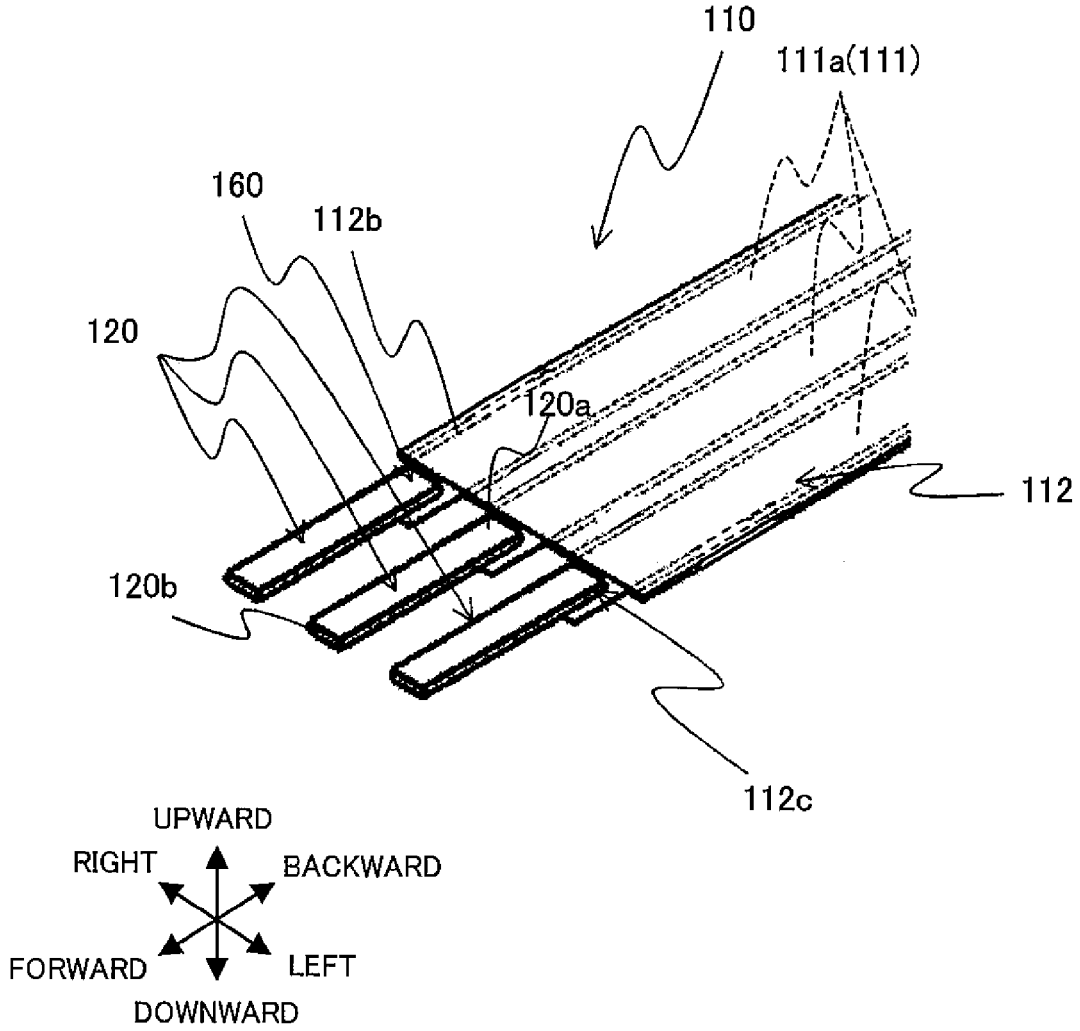
FIG. 12 is a perspective view of the flat cable as shown in FIG. 8 and terminals which are bonded to the flat cable.
Figure 13:
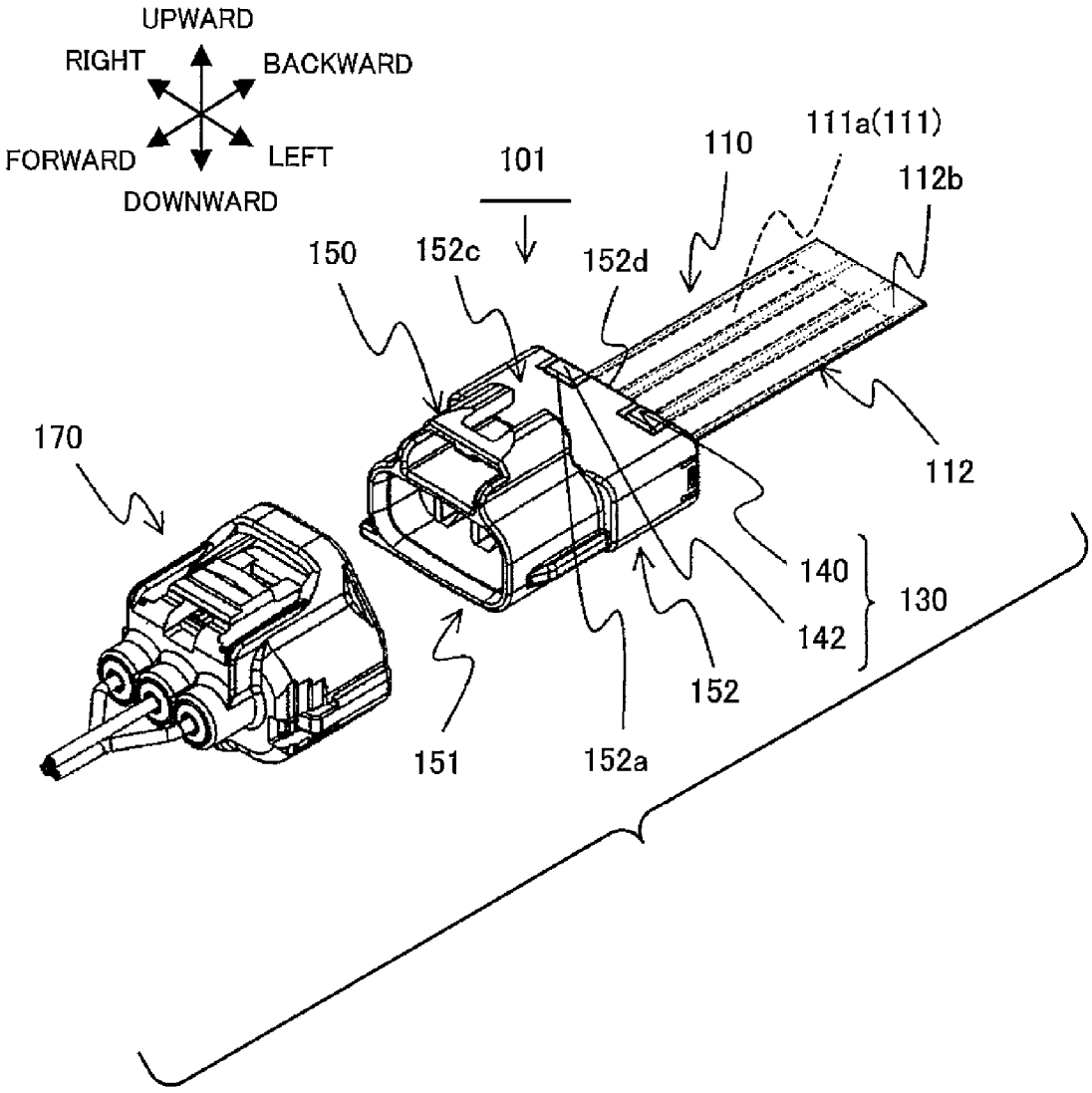
FIG. 13 is a perspective view showing the waterproofing connector structure for the flat cable, before an existing mating connector is engaged with a connector housing as shown in FIG. 8.
Figure 14:
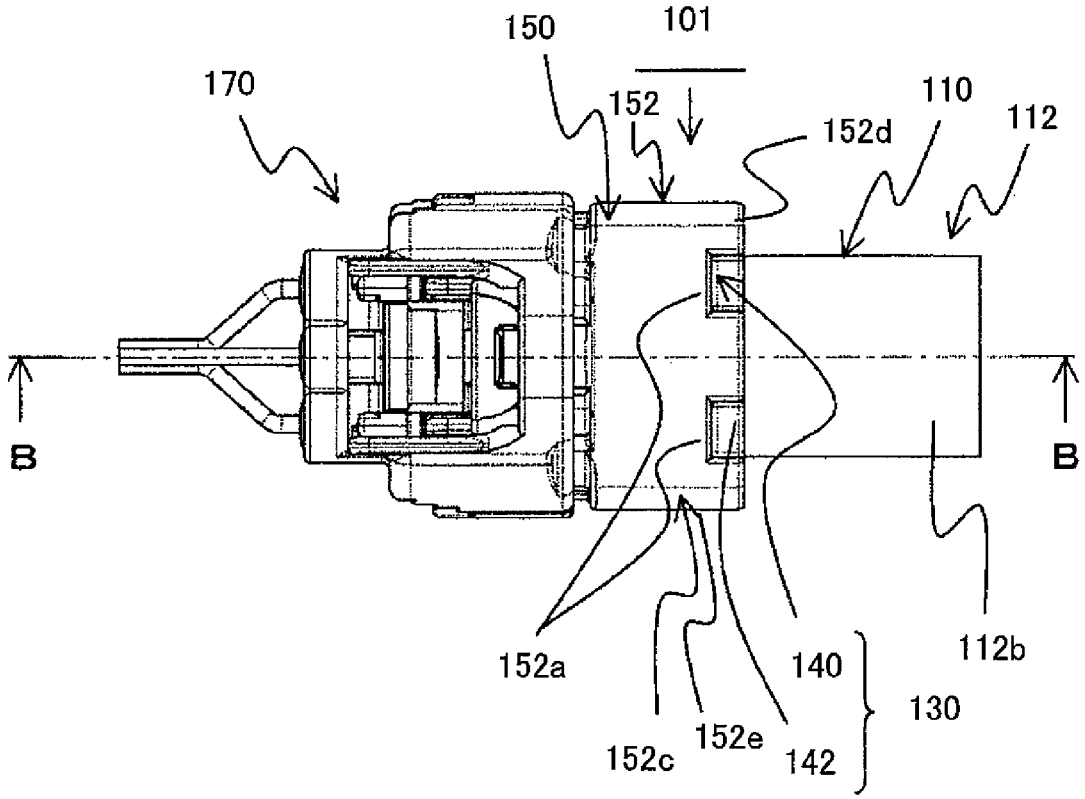
FIG. 14 is a plan view showing the waterproofing connector structure for the flat cable in which the existing mating connector as shown in FIG. 13 is engaged with the connector housing as shown in FIG. 8.
Figure 15:
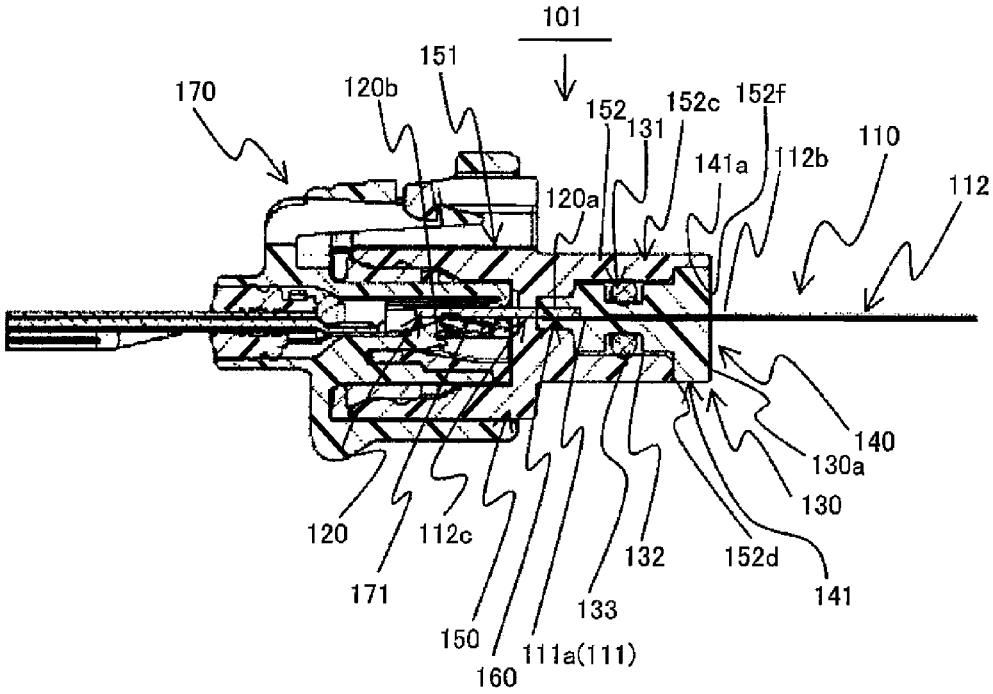
FIG. 15 is a sectional view of the mating connector and the waterproofing connector structure for the flat cable, taken along a line B-B in FIG. 14.

FIG. 8 is an exploded perspective view of a waterproofing connector structure 101 for a flat cable in a second embodiment of the present invention. FIG. 9 is a perspective view of the waterproofing connector structure 101 for the flat cable as shown in FIG. 8. FIG. 10 is a plan view of the waterproofing connector structure 101 for the flat cable as shown in FIG. 8. FIG. 11 is a sectional view of the waterproofing connector structure 101 for the flat cable taken along a line A-A in FIG. 10. FIG. 12 is a perspective view of a flat cable 110 as shown in FIG. 8 and terminals 120 which are bonded to the flat cable 110. FIG. 13 is a perspective view showing the waterproofing connector structure 101 for the flat cable, before an existing mating connector 170 is engaged with a connector housing 150 as shown in FIG. 8. FIG. 14 is a plan view showing the waterproofing connector structure 101 for the flat cable in which the existing mating connector 170 as shown in FIG. 13 is engaged with the connector housing 150 as shown in FIG. 8. FIG. 15 is a sectional view of the mating connector 170 and the waterproofing connector structure 101 for the flat cable 110, taken along a line B-B in FIG. 14.

For convenience of explanation, arrow marks intersecting each other in the drawings represent forward and backward directions, right and left directions, and upward and downward directions.

The waterproofing connector structure 101 for the flat cable includes the flat cable 110, the three terminals 120, a resin mold part 130, and the connector housing 150, as shown in FIG. 8.

The flat cable 110 as described above has flexibility because the conductor part 111 is covered with an insulating film 112*b* into a shape of a flat plate, as shown in FIG. 12. Moreover, the insulating film 112*b* is removed from a terminal connecting end 112*c* of the flat cable 110, which is an end part at a side to be connected with the terminals 120, thereby to expose respective conductor wires 111*a*. The terminals 120 are respectively bonded to the conductor wires 111*a* which are thus exposed.

Then, the three terminals 120 will be described.

Each of the three terminals 120 has a shape corresponding to the conductor wire 111*a*, and is bonded to each of the conductor wires 111*a* by ultrasonic welding, press fitting, etc. In this embodiment, the terminals 120 are male type terminals, and their end parts 120*b* at an opposite side to end parts 120*a* which are bonded to the conductor wires 111*a* are connected to terminals of a mating connector, which are not shown.

Although a case where the waterproofing connector structure 101 for the flat cable has the three terminals 120 is described, as an example, in this embodiment, the invention is not limited to the case. Specifically, it would be sufficient that the number of the terminals 120 to be provided may correspond to the number of the conductor wires 111*a*.

Then, the connector housing 150 will be described.

As shown in FIG. 13, the existing mating connector 170 is engaged with the connector housing 150, from one of both ends of the connector housing 150 opposed to each other, in such a manner that the terminals 120 and terminals 171 of the mating connector, which are not shown, are connected with each other, and the flat cable 110 is inserted from the other end.

This connector housing 150 has a first engaging part 151 to be engaged with the mating connector, and a second engaging part 152 to be engaged with the resin mold part 130.

The first engaging part 151 is formed in a cylindrical shape having an oblong outer shape in cross section so that the mating connector 170 may be fitted into the interior. Specifically, by fitting the mating connector 170 into the first engaging part 151, the terminals 120 are connected with the mating terminals 171, as shown in FIG. 15.

The second engaging part 152 is formed in a cylindrical shape having a rectangular outer shape in cross section so that the resin mold part 130 may be fitted into the interior. This second engaging part 152 has guiding cutouts 152*a* and housing openings 152*b*.

The guiding cutouts 152*a* are the cutouts in a rectangular shape which are formed in an upper wall 152*c* of the second engaging part 152 from an open edge 152*d* to an interior of the upper wall 152*c*. These guiding cutouts 152*a* are formed at two positions of the upper wall 152*c* of the second engaging part 152. The guiding cutouts 152*a* are adapted to guide upper protuberances 142 of the resin mold part 130, which will be described below, when the flat cable 110 is inserted into the connector housing 150.

The housing openings 152*b* are a pair of openings which are formed in both side walls 152*e* of the second engaging part 152. These housing openings 152*b* are adapted to be engaged with side protuberances 143 of the resin mold part 130, which will be described below.

The connector housing 150 which has such a shape that the first engaging part 151 is formed in a cylindrical shape having an oblong outer shape in cross section, and the second engaging part 152 is formed in a cylindrical shape having a rectangular outer shape in cross section has been described, as an example. However, the invention is not limited to the case. Other shapes may be adopted, provided that the mating connector 170 is engaged from one of the both ends of the connector housing 150 opposed to each other so that the terminals 120 may be connected with the terminals 171 of the mating connector, and the flat cable 110 is inserted from the other end.

Then, the resin mold part 130 will be described.

The resin mold part 130 is integrally molded on the flat cable 110 so as to cover a bonding part 160 between the conductor wires 111*a* and the terminals 120, as shown in FIG. 8.

This resin mold part 130 has a seal part 131 and a holding part 140.

The seal part 131 is a front part of the resin mold part 130, in case where the resin mold part 130 is divided in two in the longitudinal direction, and adapted to be tightly fitted to an inner wall face 152*f* of the connector housing 150.

This seal part 131 is provided with an elastic seal member 133 which is so shaped as to follow an outer periphery of the resin mold part 130 so that the seal part 131 may be tightly fitted to the inner wall face 152*f* of the connector housing 150. Specifically, the elastic seal member 133 is formed of rubber material or the like in an annular shape. Moreover, the seal part 131 has a seal member holding part 132 into which the elastic seal member 133 is to be fitted.

The seal member holding part 132 is a groove formed along an outer periphery of the seal part 131, and the elastic seal member 133 is fitted into this groove. By fitting the elastic seal member 133 into this seal member holding part 132, the connector housing 150 is tightly sealed with respect to the seal part 131, as shown in FIG. 11.

The holding part 140 is a part for holding the flat cable 110, because this holding part 140 is positioned remote from the terminal connecting end 112*c* as compared with the seal part in the longitudinal direction of the flat cable 110, and has such a shape as capable of being fitted into the connector housing 150. Specifically, the holding part 140 has a flange-shaped wall 141 uprightly provided along a backward end edge 130*a* of the resin mold part 130 and having a rectangular outer shape in cross section, upper protuberances 142 which are projected from two positions of upper edge face 141*a* of the flange-shaped wall 141, that is, an upper face of the holding part 140, and a pair of side protuberances 143 which are projected from both side edge faces 141*b* of the flange-shaped wall 141.

The two upper protuberances 142 have a substantially cubic shape corresponding to the guiding cutouts 152*a* of the connector housing 150. These upper protuberances 142 are respectively guided by the guiding cutouts 152*a* thereby to position the flat cable 110 to be inserted into the connector housing 150.

Although a case where the upper protuberances 142 and the guiding cutouts 152*a* are respectively provided at the two positions has been described, as an example, in this embodiment, the invention is not limited to the case. Specifically, it would be sufficient that the flat cable 110 can be positioned to be inserted into the connector housing 150. For example, the upper protuberance 142 may be provided at one position, and the guiding cutout 152*a* for guiding this upper protuberance 142 may be provided at one position.

A pair of the side protuberances 143 are substantially in a shape of a lance, and adapted to be respectively engaged with the housing openings 152*b* of the housing 150. Because the side protuberances 143 and the housing openings 152*b* are engaged with each other, the resin mold part 130 is fixed at a predetermined position inside the connector housing 150. Specifically, by respectively engaging the side protuberances 143 with the housing openings 152*b*, the flat cable 110 which is bonded to the terminals 120 is fixed at a predetermined position inside the connector housing 150.

Now, referring to FIGS. 16A to 16C, 17A and 17B, a method of producing the waterproofing connector structure 101 for the flat cable will be described. FIGS. 16A to 16C, 17A and 17B are views showing the method of producing the waterproofing connector structure 101 for the flat cable, as shown in FIG. 8.

As a first step, a worker removes the insulating film 112*b* from the terminal connecting end 112*c* of the flat cable 110 thereby to expose end parts of the respective conductor wires 111*a*. Then, the end parts of the conductor wires 111*a* which have been thus exposed and the terminals 120 are bonded to each other, by ultrasonic welding or press fitting, etc. (See FIG. 16A).

Figure 16A:
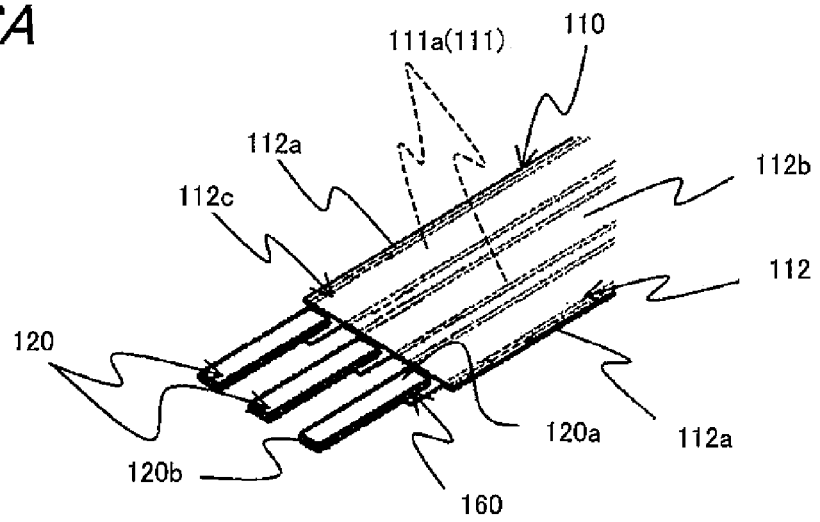
FIGS. 16A to 16C are views showing a method of producing the waterproofing connector structure for the flat cable as shown in FIG. 8.
Figure 16B:
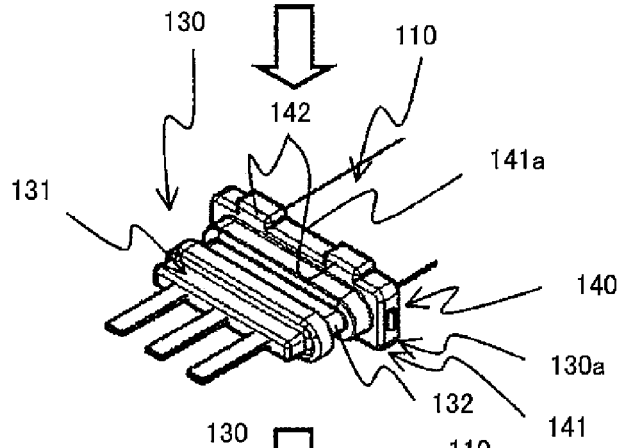

Thereafter, the worker integrally molds the resin mold part 130 on the flat cable 110 so as to cover the bonding part 160 between the conductor wires 111*a* and the terminals 120 (See FIG. 16B).

Figure 16C:
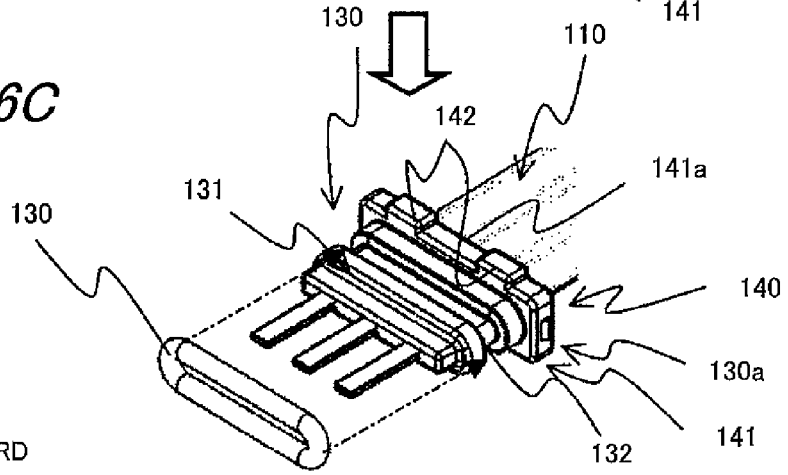
Figure 16C:
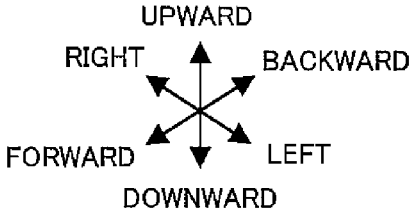

Then, the worker fits the elastic seal member 133 into the seal member holding part 132 (See FIG. 16C).

Figure 17A:
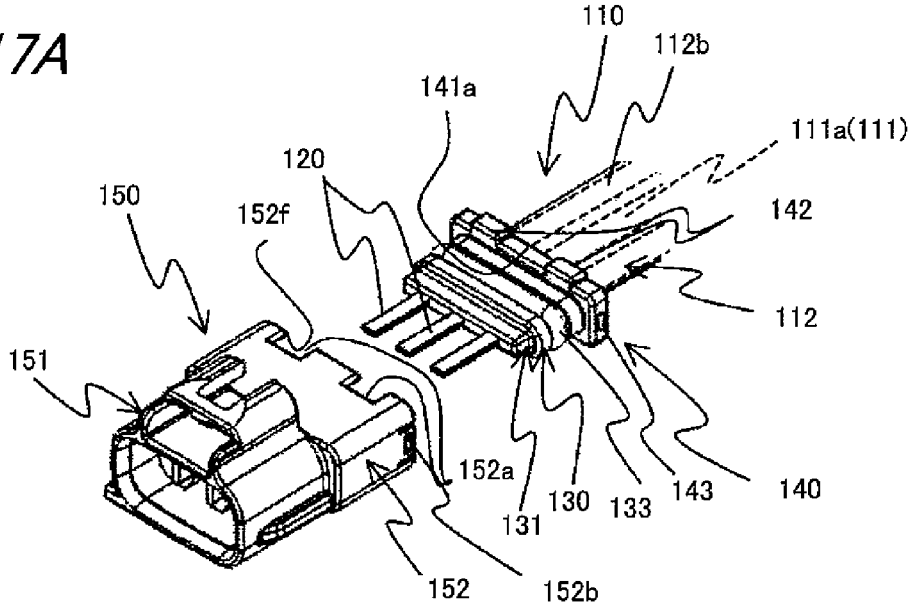
FIGS. 17A and 17B are views showing the method of producing the waterproofing connector structure for the flat cable as shown in FIG. 8.

Thereafter, the worker inserts the resin mold part 130 into the connector housing 150 (See FIG. 17A). On occasion of inserting the resin mold part 130 into the connector housing 150, the upper protuberances 142 are respectively guided by the guiding cutouts 152*a* thereby to position the resin mold part 130 to be inserted into the connector housing 150. The resin mold part 130 can be easily inserted into the connector housing 150, because the resin mold part 30 has higher rigidity than the elastic seal member 133 and is unlikely to be deformed.

Figure 17B:
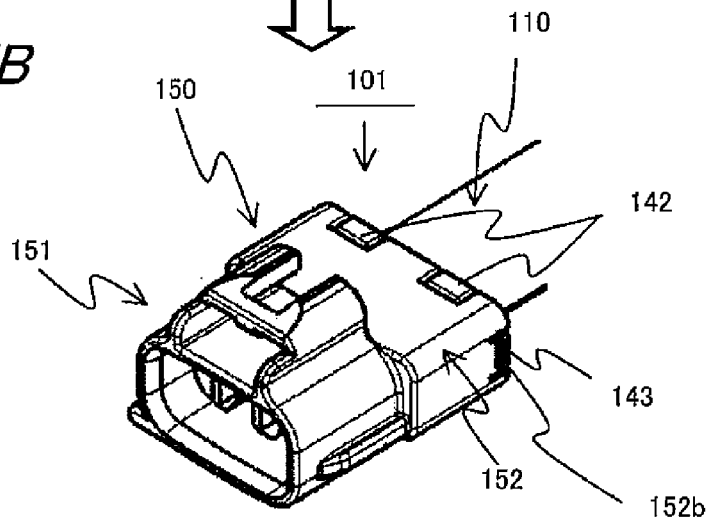
Figure 17B:
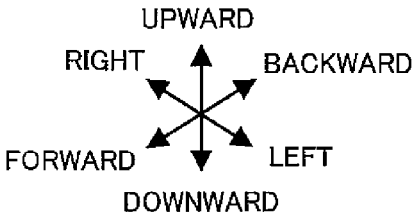

Thereafter, the worker allows a pair of the housing openings 152*b* to be respectively engaged with the side protuberances 143 of the resin mold part 130 (See FIG. 17B). In this manner, the waterproofing connector structure 101 for the flat cable is completed. By attaching the resin mold part 130 to the connector housing 150, as described above, the seal part 131 is tightly fitted to the inner wall face 152*f* of the connector housing 150 by means of the elastic seal member 133, and the holding part 140 is fitted into the connector housing 150 thereby to hold the flat cable 110.

Moreover, by attaching the resin mold part 130 to the connector housing 150, the terminals 120 respectively bonded to the conductor wires 111*a* are contained in the connector housing 150 thereby to function as a male connector. Specifically, in the waterproofing connector structure 101 for the flat cable, there is no necessity of providing a relay terminal inside the connector housing 150.

The waterproofing connector structure 101 for the flat cable according to the second embodiment of the present invention includes the seal part 131 where the elastic seal member 133 which is so shaped as to follow the outer periphery of the resin mold part 130 so as to be tightly fitted to the inner wall face 152*f* of the connector housing 150 is provided, and the holding part 140 which is arranged remote from the terminal connecting end 112*c* of the flat cable 110, as compared with the seal part 131 in the longitudinal direction, and has such a shape as to be fitted into the connector housing 150, thereby to hold the flat cable 110. Because waterproofing performance is given by the elastic seal member 133 which is provided in the seal part 131, and the resin mold part 130 has higher rigidity than the elastic seal member 133 and is unlikely to be deformed, a gap hardly occurs between the inner wall face 152*f* of the connector housing 150 and the elastic seal member 133. Consequently, deterioration of waterproofing performance can be prevented, even in case where an external force is exerted on the flat cable.

In the waterproofing connector structure 101 for the flat cable according to the second embodiment of the present invention, by attaching the resin mold part 130 to the connector housing 150, the terminal 20 which is bonded to the conductor wire 111*a* is contained in the connector housing 150. Therefore, there is no necessity of assembling a relay terminal for connecting the terminal to the conductive wire into the connector housing 150. As the results, assembling work can be facilitated.

In the waterproofing connector structure 101 for the flat cable according to the second embodiment of the present invention, the resin mold part 130 can be easily inserted into the connector housing 150, because the resin mold part 130 has higher rigidity than the elastic seal member 133, and is unlikely to be deformed.

In the waterproofing connector structure 101 for the flat cable according to the second embodiment of the present invention, the seal part 131 has the seal member holding part 132 in a form of a groove which is formed along the outer periphery of the seal part 131, and the elastic seal member 33 is in an annular shape, and fitted into the seal member holding part 132. Therefore, the elastic seal member 133 is held so as not to be easily deformed, and consequently, the waterproofing performance can be enhanced.

In the waterproofing connector structure 101 for the flat cable according to the second embodiment of the present invention, the connector housing 150 has the guiding cutout 52*a* in a shape of a rectangular cutout which is formed in the upper wall 52*c* of the connector housing 150, from the open edge 152*d* at a side where the resin mold part 130 is inserted to the interior of the upper wall, and the holding part 140 has the upper protuberance 142 which is projected from the upper face 141*a* of the holding part 140. When the resin mold part 130 is inserted into the connector housing 150, the upper protuberance 142 is guided by the guiding cutout 152*a*, and therefore, the resin mold part 130 can be easily inserted into the connector housing 150.

(Modification)

Figure 18:
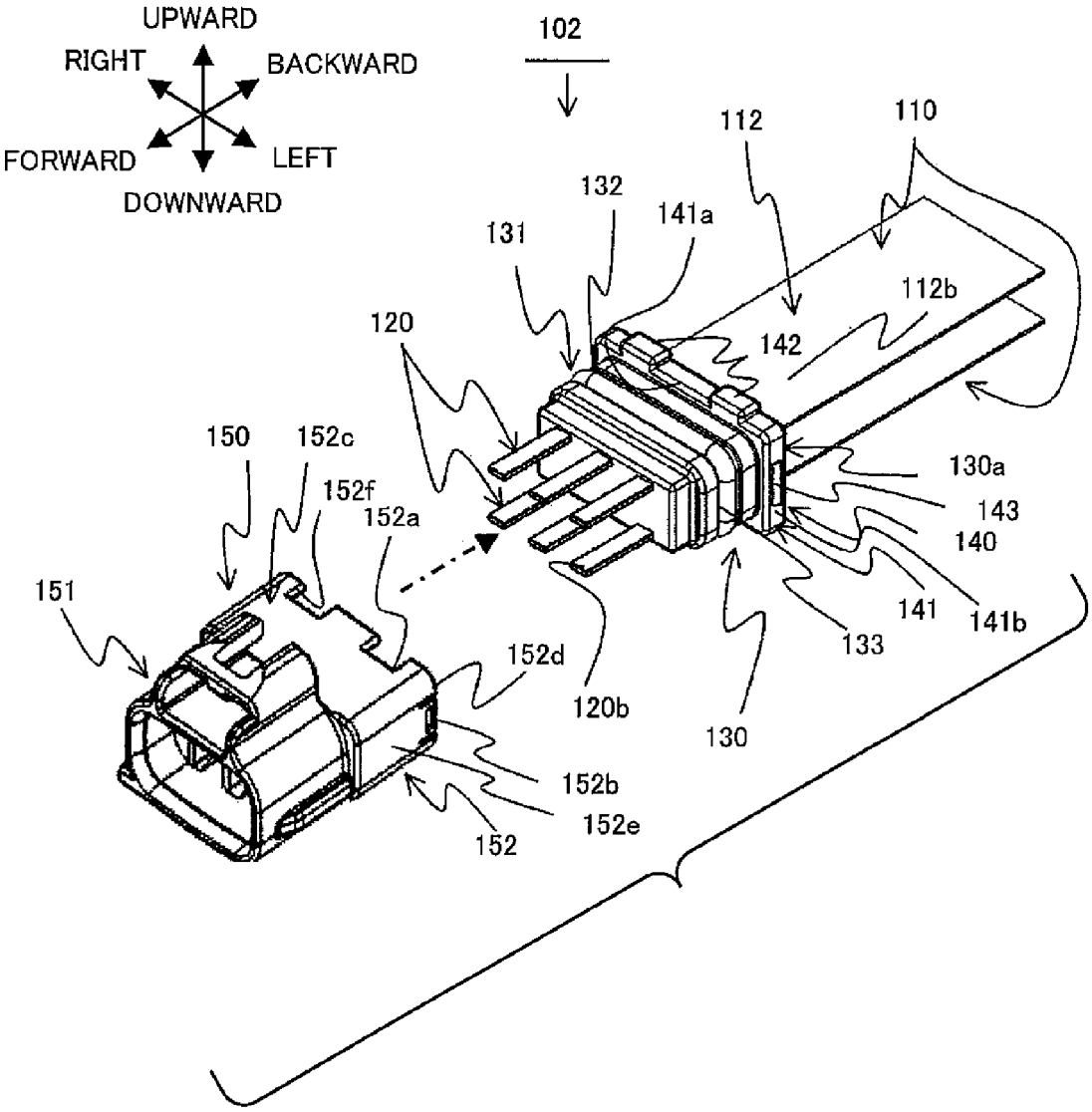
FIG. 18 is a perspective view showing a waterproofing connector structure for a flat cable in a modification of the second embodiment according to the present invention.

Now, referring to FIG. 18, a modification of the second embodiment according to the present invention will be described. FIG. 18 is a perspective view of a waterproofing connector structure 102 for a flat cable in the modification of the second embodiment according to the invention.

Although the waterproofing connector structure 101 for the flat cable which has a sheet of the flat cable has been shown, as an example, in the second embodiment according to the invention, the waterproofing connector structure 102 for the flat cable in this modification is different from the waterproofing connector 101 of the flat cable in the embodiment in that two sheets of the flat cables are arranged in parallel in a vertical direction.

It is to be noted that other structures are substantially the same as those of the embodiment, and the same components as in the embodiment are denoted with the same reference numerals.

In the waterproofing connector structure 102 for the flat cable in this modification, waterproofing performance is given by the elastic seal member 133 which is provided in the seal part 131, and the resin mold part 130 has higher rigidity than the elastic seal member 133 and is unlikely to be deformed. As the results, substantially the same advantage as the second embodiment can be attained.

In the waterproofing connector structures 101 and 102 of the flat cable which have been described in the second embodiment according to the present invention, the holding part 140 is uprightly provided along the backward end edge 130*a* of the resin mold part 130, and provided with the flange-shaped wall 141 having a rectangular outer shape in cross section, the upper protuberances 142 which are projected from the two positions of the upper edge face 141*a* of the flange-shaped wall 141, and a pair of the side protuberances 143 which are projected from the both side edge faces 141*b* of the flange-shaped wall 141. However, the invention is not limited to the case. Specifically, other shapes may be adopted, provided that the holding part 140 is positioned remote from the terminal connecting end 112*c* of the flat cable 110 as compared with the seal part 131 in the longitudinal direction of the flat cable 110, and has such a shape as capable of being fitted into the connector housing 150 thereby to hold the flat cable 110.

The invention which has been made by the inventor has been specifically described, referring to the above described embodiment according to the invention. However, the invention is not limited to the above described embodiment according to the invention, but various modifications can be made within a scope not deviating from a gist of the invention.

INDUSTRIAL APPLICABILITY

The present invention is useful for providing a flat cable waterproofing connector in which deterioration of waterproofing performance can be prevented, even in case where a tensile force is exerted on a flat cable.

What is claimed is:

1. A flat cable waterproofing connector, comprising:

a flat cable having an insulating covering part where a conductor wire is covered with an insulating film, the flat cable having a pair of side end parts that are opposed to each other in a lateral direction of the insulating covering part, and the flat cable having a pair of cutouts which are formed in both side end parts opposed to each other in a lateral direction of the insulating covering part and openings which are formed in the insulating covering part at such positions as to be longitudinally spaced forward of the cutouts in a connecting direction, a terminal bonded to the conductor wire, and a connector housing which is engaged with a mating connector so that the terminal is connected with a terminal of the mating connector, wherein the flat cable includes a first width at a location longitudinally spaced forward of the cutouts in a connecting direction, a second width at a location longitudinally spaced rearward of the cutouts, and a third width at a location that includes the pair of cutouts, where the first and second widths are each greater than the third width, the flat cable waterproofing connector includes a resin mold part which is integrally molded on an end part in a longitudinal direction of the flat cable so as to cover a bonding part between the conductor wire and the terminal, and the resin mold part has a waterproofing mold part for covering the bonding part, and a holding mold part for covering the flat cable at a deeper side in the longitudinal direction of the flat cable than the waterproofing mold part, wherein the holding mold part is formed so as to cover the openings and respective one edges of the cutouts in a direction perpendicular to the longitudinal direction of the flat cable.

2. A flat cable waterproofing connector as set forth in claim 1, wherein the waterproofing mold part has a seal part to be tightly fitted to an inner wall face of the connector housing, and the holding mold part has such a shape as to be fitted into the connector housing.

3. A flat cable waterproofing connector as set forth in claim 2, wherein the flat cable has a plurality of the conductor wires, and the openings are provided between a respective two conductor wires out of the plurality of the conductor wires.

4. A flat cable waterproofing connector as set forth in claim 2, wherein the seal part includes an annular seal member having elasticity which is provided along an outer periphery of the waterproofing mold part.

* * * * *